US012790798B2

(12) United States Patent
Torak et al.

(10) Patent No.: US 12,790,798 B2
(45) Date of Patent: Nov. 10, 2026

(54) WATERFALL DECKPLATE

(71) Applicant: Kraus USA Plumbing LLC, Washington, NY (US)

(72) Inventors: Serhiy Torak, Noblesville, IN (US); Todd Alexander, Hollis, NH (US)

(73) Assignee: Kraus USA Plumbing LLC, Port Washington, NY (US)

( * ) Notice: Subject to any disclaimer, the term of this patent is extended or adjusted under 35 U.S.C. 154(b) by 0 days.

(21) Appl. No.: 19/045,967

(22) Filed: Feb. 5, 2025

(65) Prior Publication Data

US 2025/0270797 A1 Aug. 28, 2025

Related U.S. Application Data

(60) Provisional application No. 63/650,548, filed on May 22, 2024, provisional application No. 63/556,974, filed on Feb. 23, 2024.

(51) Int. Cl.
*E03C 1/04* (2006.01)

(52) U.S. Cl.
CPC ..... *E03C 1/0404* (2013.01)

(58) Field of Classification Search
CPC ..... E03C 1/0404
See application file for complete search history.

(56) References Cited

U.S. PATENT DOCUMENTS

| | | | | |
|---|---|---|---|---|
| 6,073,278 | A * | 6/2000 | Ball | E03C 1/24 4/694 |
| 7,721,761 | B2 * | 5/2010 | Thomas | F16K 11/022 137/119.04 |
| 7,753,074 | B2 | 7/2010 | Rosko et al. | |
| 8,375,990 | B2 | 2/2013 | Veros | |
| 8,469,056 | B2 | 6/2013 | Marty et al. | |
| 2006/0180213 | A1 * | 8/2006 | Ko | E03C 1/04 137/606 |
| 2012/0124737 | A1 * | 5/2012 | Gibson | E03C 1/048 4/643 |

(Continued)

OTHER PUBLICATIONS

Hansgrohe, The Aquno Select: Perfect for smart applications and easy workflows, retrieved on Nov. 27, 2023 from https://www.hansgrohe-usa.com/kitchen/new-products/aquno, 9 pages.

*Primary Examiner* — Patrick C Williams
(74) *Attorney, Agent, or Firm* — Bose McKinney & Evans LLP

(57) ABSTRACT

A waterfall deckplate assembly that includes a deckplate structure adapted to be mounted on a horizontal surface and a fluid conveyance system coupled with deckplate structure. The fluid conveyance system is adapted to be connected to a fluid supply and includes a plurality of discharge nozzles supported by the deckplate structure wherein the plurality of discharge nozzles are horizontally aligned when the deckplate structure is mounted on the horizontal surface; and a user operable control valve wherein the control valve is operable to independently and selectively allow fluid flow to the discharge nozzles and prevent fluid flow to the discharge nozzles. In some embodiments, the plurality of nozzles are formed on a first nozzle manifold and the deckplate assembly includes a storage compartment for a second nozzle manifold having a second plurality of discharge nozzles.

27 Claims, 25 Drawing Sheets

(56) References Cited

U.S. PATENT DOCUMENTS

| | | | | |
|---|---|---|---|---|
| 2017/0320073 | A1* | 11/2017 | Sunshine | B05B 1/185 |
| 2018/0147595 | A1* | 5/2018 | Vogtner | E04H 4/148 |
| 2020/0277770 | A1* | 9/2020 | Hong | A47B 77/022 |
| 2021/0052131 | A1* | 2/2021 | Cipriani | A47L 17/00 |
| 2024/0068212 | A1* | 2/2024 | Ayala | E03C 1/046 |
| 2025/0067032 | A1* | 2/2025 | Sapp | E03C 1/048 |

* cited by examiner

WATERFALL DECKPLATE

CROSS REFERENCE TO RELATED APPLICATIONS

This application claims priority under 35 U.S.C. 119(e) of U.S. provisional patent application Ser. No. 63/556,974 filed on Feb. 23, 2024 and U.S. provisional patent application Ser. No. 63/650,548 filed on May 22, 2024, the disclosures of both of which are hereby incorporated herein by reference.

BACKGROUND AND SUMMARY OF THE DISCLOSURE

The present disclosure relates to a fluid dispensing device and, more particularly, to a waterfall deckplate for dispensing water.

Waterfall fluid dispensers are known in the art. For example, it is known to combine waterfall dispensers with a kitchen faucet whereby fluid can be dispensed from either the waterfall dispenser or the faucet into a kitchen sink. In such an application, the waterfall dispenser can beneficially be used to wash or rinse fresh produce and other food.

While known dispensers are useful, further improvements remain desirable.

The present disclosure discloses a waterfall deckplate assembly which includes a deckplate structure adapted to be mounted on a horizontal surface, and a fluid conveyance system coupled with deckplate structure, the fluid conveyance system adapted to be connected to a fluid supply and including: a plurality of discharge nozzles supported by the deckplate structure wherein the plurality of discharge nozzles are horizontally aligned when the deckplate structure is mounted on the horizontal surface; and a user operable control valve wherein the control valve is operable to selectively allow fluid flow to the discharge nozzles and prevent fluid flow to the discharge nozzles.

In some embodiments of the waterfall deckplate assembly, the control valve is a positioned downstream of a mixing valve adapted to be coupled with a hot water supply and a cold water supply and a diverter valve is disposed between the mixing valve and the control valve, the diverter valve being couplable with a faucet. The faucet may be mounted on the deckplate assembly or mounted separately and spaced apart from the deckplate assembly.

In some embodiments of the waterfall deckplate assembly, the plurality of discharge nozzles are adjustable nozzles.

In some embodiments of the waterfall deckplate assembly, the deckplate structure defines an opening adapted to receive a faucet assembly. The opening is, in some embodiments, centrally located on the deckplate assembly.

In some embodiments of the waterfall deckplate assembly, the control valve includes a user operable actuator projecting above the deckplate structure for operating the control valve. In some embodiments, there are a plurality of user operable actuators interchangeably installable on the control valve wherein each of the plurality of user operable actuators has a different exterior appearance.

In some embodiments of the waterfall deckplate assembly, the plurality of discharge nozzles are disposed on a first nozzle manifold and the assembly includes a second plurality of discharge nozzles disposed on a second nozzle manifold, the first and second nozzle manifolds being interchangeably installable in the fluid conveyance system; and wherein the deckplate structure defines a storage compartment whereby one of the first and second nozzle manifolds not installed in the fluid conveyance system is storable in the storage compartment.

In some embodiments of the waterfall deckplate assembly, the plurality of discharge nozzles are disposed on a nozzle manifold wherein the nozzle manifold includes at least one flexible prong for engaging the assembly and thereby securing the nozzle manifold to the assembly and the assembly includes a user-accessible engagement member wherein manual manipulation of the engagement member disengages the at least one flexible prong and thereby allows removal of the nozzle manifold from the assembly.

In some embodiments of the waterfall deckplate assembly, the control valve is a mixing valve adapted to be coupled with a hot water supply and a cold water supply.

In some embodiments of the waterfall deckplate assembly, the waterfall deckplate assembly is adapted to be mounted proximate a faucet whereby both the waterfall deckplate assembly and the faucet discharge fluid into a common basin with the faucet being mounted separately and spaced apart from the deckplate assembly.

Another embodiment takes the form of a waterfall deckplate assembly that includes a deckplate structure adapted to be mounted on a horizontal surface; a first plurality of discharge nozzles disposed on a first nozzle manifold and a second plurality of discharge nozzles disposed on a second nozzle manifold; a fluid conveyance system coupled with deckplate structure, the fluid conveyance system being couplable with a selected one of the first nozzle manifold and the second nozzle manifold, and wherein the fluid conveyance system is connectable to a fluid supply to thereby convey fluid to the selected one of the first nozzle manifold and the second nozzle manifold coupled with the fluid conveyance system; a user operable control valve disposed in the fluid conveyance system wherein the control valve is operable to selectively allow fluid flow to the discharge nozzles and prevent fluid flow to the discharge nozzles; and wherein the first nozzle manifold and the second nozzle manifold are interchangeably couplable to the fluid conveyance system and the deckplate structure defines a storage compartment whereby a non-coupled one of the first nozzle manifold and the second nozzle manifold is storable in the storage compartment.

In some embodiments of the waterfall deckplate assembly, the plurality of discharge nozzles of the nozzle manifold coupled with the fluid conveyance system are horizontally aligned when the deckplate structure is mounted on the horizontal surface.

In some embodiments of the waterfall deckplate assembly, the storage compartment is disposed below the nozzle manifold coupled with the fluid conveyance system when the deckplate structure is mounted on the horizontal surface. In some embodiments, the nozzle manifold coupled with the fluid conveyance system discharges fluid from a first elongate side of the deckplate structure and the storage compartment is accessible through a removable cover disposed on a second elongate side of the deckplate structure disposed opposite the first elongate side.

In some embodiments of the waterfall deckplate assembly, at least one of the first plurality of discharge nozzles and the second plurality of discharge nozzles are adjustable nozzles.

In some embodiments of the waterfall deckplate assembly, the plurality of discharge nozzles are disposed on a nozzle manifold wherein the nozzle manifold includes at least one flexible prong for engaging the assembly and thereby securing the nozzle manifold to the assembly and the assembly includes a user-accessible engagement member wherein manual manipulation of the engagement member disengages the at least one flexible prong and thereby allows removal of the nozzle manifold from the assembly.

Another embodiment takes the form of a faucet assembly that includes a faucet having a waterway connectable to a water supply, the waterway extending to a discharge outlet, and a user operable first control valve for controlling the flow of water through the waterway to the discharge outlet; and a deckplate assembly that includes: a deckplate structure adapted to be mounted on a horizontal surface; and a fluid conveyance system coupled with deckplate structure, the fluid conveyance system adapted to be connected to a fluid supply and including: a plurality of discharge nozzles supported by the deckplate structure wherein the plurality of discharge nozzles are horizontally aligned when the deckplate structure is mounted on the horizontal surface; and a user operable second control valve wherein the second control valve is operable to selectively allow fluid flow to the discharge nozzles and prevent fluid flow to the discharge nozzles independently of the operation of the first control valve.

In some embodiments of the faucet assembly, the first control valve is a mixing valve adapted to be coupled with a hot water supply and a cold water supply and a diverter valve is disposed between the mixing valve and the second control valve, with both the waterway and the fluid conveyance system being disposed downstream of the diverter valve and the mixing valve being disposed upstream of the diverter valve.

In some embodiments of the faucet assembly, the second control valve includes a user operable actuator projecting above the deckplate structure for operating the second control valve. The faucet assembly may also include a plurality of user operable actuators interchangeably installable on the second control valve, each of the plurality of user operable actuators having a different exterior appearance.

In some embodiments of the faucet assembly, the plurality of discharge nozzles are disposed on a first nozzle manifold and the assembly includes a second plurality of discharge nozzles disposed on a second nozzle manifold, the first and second nozzle manifolds being interchangeably installable in the fluid conveyance system; and wherein the deckplate structure defines a storage compartment whereby one of the first and second nozzle manifolds not installed in the fluid conveyance system is storable in the storage compartment.

In some embodiments of the faucet assembly, the plurality of discharge nozzles are disposed on a nozzle manifold wherein the nozzle manifold includes at least one flexible prong for engaging the assembly and thereby securing the nozzle manifold to the assembly and the assembly includes a user-accessible engagement member wherein manual manipulation of the engagement member disengages the at least one flexible prong and thereby allows removal of the nozzle manifold from the assembly.

In some embodiments of the faucet assembly the deckplate structure defines an opening and the faucet is mounted on the deckplate structure at the opening.

In some embodiments of the faucet assembly the waterfall deckplate assembly is adapted to be mounted proximate the faucet whereby both the waterfall deckplate assembly and the faucet discharge fluid into a common basin with the faucet being mounted separately and spaced apart from the deckplate assembly.

Yet another embodiment takes the form of a faucet assembly that includes a faucet having a waterway connectable to a water supply, the waterway extending to a discharge outlet, and a user operable first control valve for controlling the flow of water through the waterway to the discharge outlet; and a deckplate assembly that includes: a deckplate structure adapted to be mounted on a horizontal surface; a first plurality of discharge nozzles disposed on a first nozzle manifold and a second plurality of discharge nozzles disposed on a second nozzle manifold; a fluid conveyance system coupled with deckplate structure, the fluid conveyance system being couplable with a selected one of the first nozzle manifold and the second nozzle manifold, and wherein the fluid conveyance system is connectable to a fluid supply to thereby convey fluid to the selected one of the first nozzle manifold and the second nozzle manifold coupled with the fluid conveyance system; a user operable control valve disposed in the fluid conveyance system wherein the control valve is operable to selectively allow fluid flow to the discharge nozzles and prevent fluid flow to the discharge nozzles; and wherein the first nozzle manifold and the second nozzle manifold are interchangeably couplable to the fluid conveyance system and the deckplate structure defines a storage compartment whereby a non-coupled one of the first nozzle manifold and the second nozzle manifold is storable in the storage compartment.

In some embodiments of the faucet assembly, the plurality of discharge nozzles of the nozzle manifold coupled with the fluid conveyance system are horizontally aligned when the deckplate structure is mounted on the horizontal surface.

In some embodiments of the faucet assembly, the storage compartment is disposed below the nozzle manifold coupled with the fluid conveyance system when the deckplate structure is mounted on the horizontal surface. The faucet assembly may be configured such that the nozzle manifold coupled with the fluid conveyance system discharges fluid from a first elongate side of the deckplate structure and the storage compartment is accessible through a removable cover disposed on a second elongate side of the deckplate structure disposed opposite the first elongate side.

In some embodiments of the faucet assembly, the plurality of discharge nozzles are disposed on a nozzle manifold wherein the nozzle manifold includes at least one flexible prong for engaging the assembly and thereby securing the nozzle manifold to the assembly and the assembly includes a user-accessible engagement member wherein manual manipulation of the engagement member disengages the at least one flexible prong and thereby allows removal of the nozzle manifold from the assembly.

Additional features and advantages of the present invention will become apparent to those skilled in the art upon consideration of the following detailed description of the illustrative embodiments.

BRIEF DESCRIPTION OF THE DRAWINGS

A detailed description of the drawings particularly refers to the accompanying figures, in which.

Corresponding reference characters indicate corresponding parts throughout the several views.

DETAILED DESCRIPTION OF THE DRAWINGS

Figure 1A:
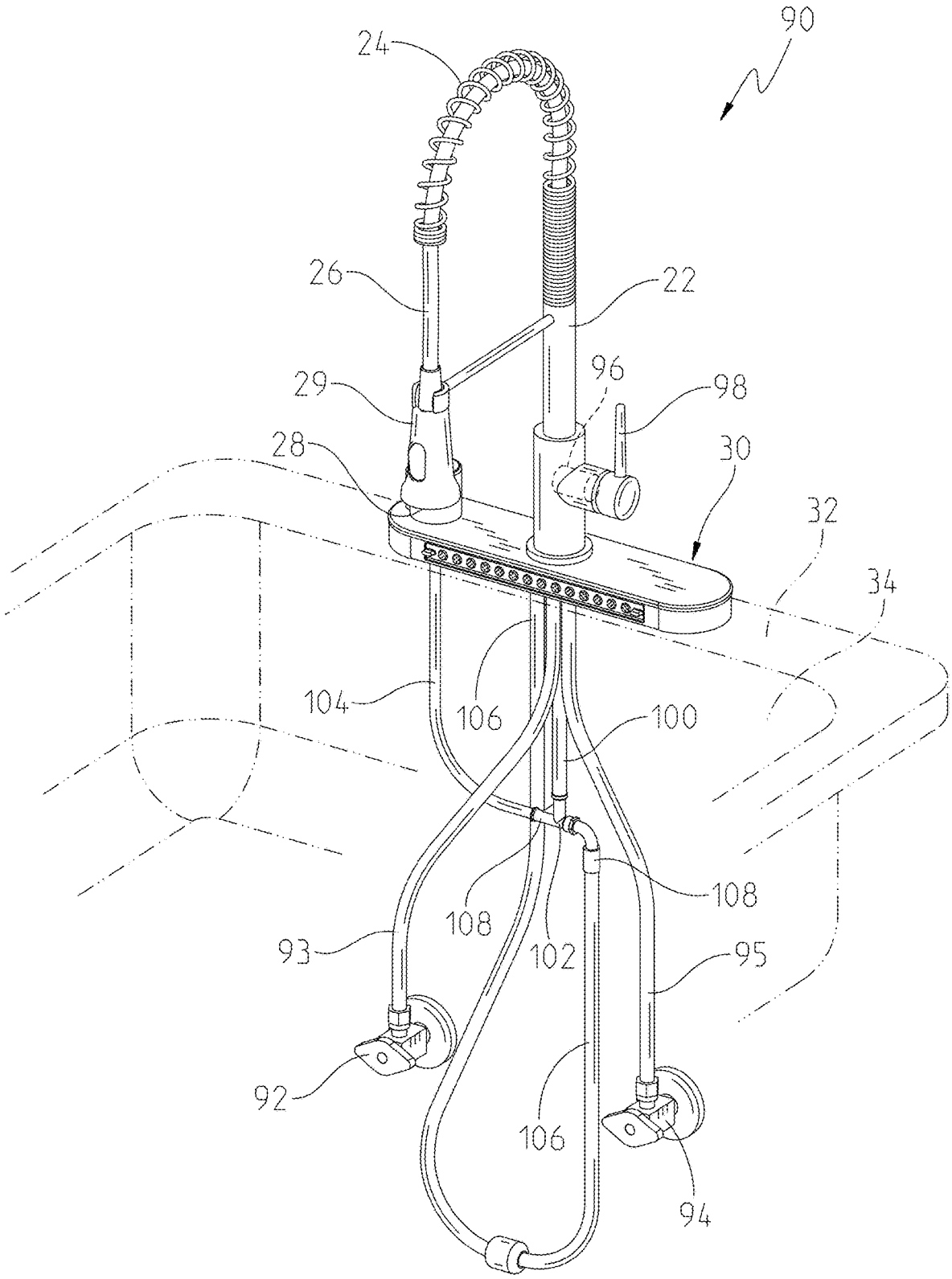
FIG. 1A is a perspective view of an illustrative waterfall deckplate if the present disclosure supported by a sink basin and operably coupled to a faucet.

For the purposes of promoting and understanding the principles of the present disclosure, reference will now be made to the embodiments illustrated in the drawings, which are described herein. The embodiments disclosed herein are not intended to be exhaustive or to limit the invention to the precise forms disclosed. Rather, the embodiments are chosen and described so that others skilled in the art may utilize their teachings. Therefore, no limitation of the scope of the claimed invention is thereby intended. The present invention includes any alterations and further modifications of the illustrated devices and described methods and further applications of principles in the invention which would normally occur to one skilled in the art to which the invention relates.

A faucet assembly 20 is shown in FIG. 1A and includes a faucet 22 and a waterfall deckplate assembly 30. In the illustrated embodiment, faucet 22 is a conventional spring faucet having a spring 24 that surrounds a flexible portion 26 and a discharge outlet 28, illustratively defined by a movable sprayhead 29. Other forms of faucets may also be employed with deckplate assembly 30.

In FIG. 1A, deckplate assembly 30 is shown mounted on a sink deck or rim 32 of a kitchen sink whereby the faucet assembly 20 may discharge fluid, e.g., water, into the basin 34 of the kitchen sink. Rim 32 provides a substantially flat horizontal surface for mounting deckplate assembly 30, however, deckplate assembly 30 may also be mounted on alternative surfaces. For example, deckplate assembly 30 could be mounted on the upper surface of a countertop positioned adjacent a sink basin. Advantageously, the surface on which the deckplate assembly is mounted is a substantially flat and horizontal surface.

Deckplate assembly 30 is illustrated in FIGS. 1A-7 and includes a deckplate structure 36 adapted to be mounted on a horizontal surface. The illustrative deckplate structure 36 includes a framework 38 and a cover plate 40. Cover plate 40 includes a plurality of prongs 41 that are used to provide a snap-fit connection between cover plate 40 and framework 38, however, alternative attachment methods may also be employed. Hollow attachment posts or mounting shanks 42, 44 are secured to framework 38 and extend downwardly through openings in a horizontal supporting member when deckplate assembly 30 is mounted on the upper surface of the horizontal supporting member. In the illustrated embodiments, posts 42, 44 are externally threaded and threaded nuts 46 are threaded onto posts 42, 44 to engage the underside of the horizontal supporting member and thereby secure the deckplate assembly to the horizontal supporting member, e.g., the rim of a sink or a countertop. Post 42 is also threadingly engaged with a threaded bore in framework 38 to secure the post 42 to framework 38. Alternative configurations may also be employed, e.g., post 42 may be integrally formed with framework 38 or be secured to framework 38. Furthermore, a retaining member on the underside of the horizontal supporting member using a different attachment method, e.g., friction fit, interference fit, bayonet coupling, adhesive and/or some other suitable attachment method may alternatively be used with posts 42, 44.

In the illustrated embodiment, post 44 is a hollow member having a central bore that extends the entire length of post 44. Post 44 also includes an upper section 48 in which control valve 50 is positioned. A lateral, hollow, cylindrical extension 52 extends outwardly from upper section 48. Extension 52 includes two circumferential grooves on its cylindrical exterior surface for seating O-ring seals 54. A fluid line 104 conveys fluid to control valve 50 and, when control valve 50 is open, the fluid is allowed to flow through extension 52 to manifold assembly 60. See FIG. 11A for an exploded view of manifold assembly 160. As further discussed below, manifold assembly 60 is identical to manifold assembly 160 except that the manifold housing 172 of manifold assembly 160 includes a pair of brackets 174 on the rear wall of manifold housing 172.

Post 44 includes lateral tabs 62 that are engaged in a slot and rest on a shelf in framework 38 such that tightening nut 46 on post 44 secures framework 38 to the horizontal supporting member by the compressive forces between tabs 62 and nut 46. Threaded fasteners (not shown) are used to firmly secure tabs 62 to framework 38. It is noted that upper section 48 can be integrally formed with post 44 or secured thereto. In the illustrated embodiment, upper section 48 is threadingly secured to post 44. After attaching upper section 48 to post 44, the combined assembly is secured to framework 38 via tabs 62 and threaded fasteners. In other embodiments, the section that is used to house control valve 50 could be entirely separate from the structural member used to secure deckplate assembly 30 to the horizontal supporting member.

A nut 58 is used to secure control valve 50 within upper section 48. Opposing slots in the upper edge of upper section 48 are used to engage lateral projections on control valve 50 to prevent relative rotation of the valve housing with upper section 48. A user operable actuator 64 or knob is coupled with control valve 50, e.g., by engaging a stem on valve 50, whereby a user may rotate knob 64 to open and close valve 50. Valve 50 is a conventional fluid valve such as a ball valve, diaphragm valve or other suitable fluid valve.

Opening valve 50 allows fluid to flow to extension 52 and then to nozzle manifold 60. Closing valve 50 prevents the flow of fluid to extension 52 which thereby prevents the flow of fluid to nozzle manifold 60. Extension 52 is sealingly received in end cap 66 of nozzle manifold 60. End cap 66 has a tubular extension 68 similar to extension 52 on which O-ring seals 70 are seated. End cap 66 defines an internal passageway that is in fluid communication with the interior bore of extension 52 and extends through tubular extension 68. Tubular extension 68 is received in manifold body 76 whereby fluid can flow from control valve 50, through extension 52 and end cap 66 into manifold body 76. Manifold body 76 is disposed in manifold housing 72 which, in turn, is supported on framework 38. An opposing end cap 74 is engaged with the capped end of manifold body 76 which is opposite end cap 66. Opposing end cap 74 has a configuration identical to end cap 66, however, manifold body has an opening allowing end cap 66 to communicate with internal passage 78 while the other end of passage 78 is a blind bore whereby fluid cannot flow into end cap 74. A short blind bore having a depth equivalent to tubular extension 68 receives the tubular extension 68 of end cap 74. In addition to internal passage 78, manifold body 76 also defines a plurality of discharge nozzles 80. Fluid entering passage 78 from end cap 66 is discharged from nozzles 80 to form a waterfall discharge. In this regard, it is noted that the discharge nozzles 80 are horizontally aligned when the deckplate structure is mounted on the horizontal surface to thereby form a waterfall discharge. When valve 50 is open, fluid is allowed to flow to discharge nozzles 80, it will be discharged from nozzles in the form of a waterfall and when valve 50 is closed, fluid is prevented from flowing to discharge nozzles 80 and the fluid flow from nozzles 80 will thereby be terminated.

In other words, valve 50 toggles the water flow on and off through the fluid conveyance system 31 of the waterfall deckplate assembly. Fluid conveyance system 31 includes all those elements of the waterfall deckplate assembly that control and convey fluid through the assembly which, in waterfall deckplate assembly 30, include valve 50, extension 52 and manifold assembly 60. The fluid is discharged through the plurality of discharge nozzles 80 which are a part of manifold assembly 60 and also a part of the fluid conveyance system 31.

Figure 11A:
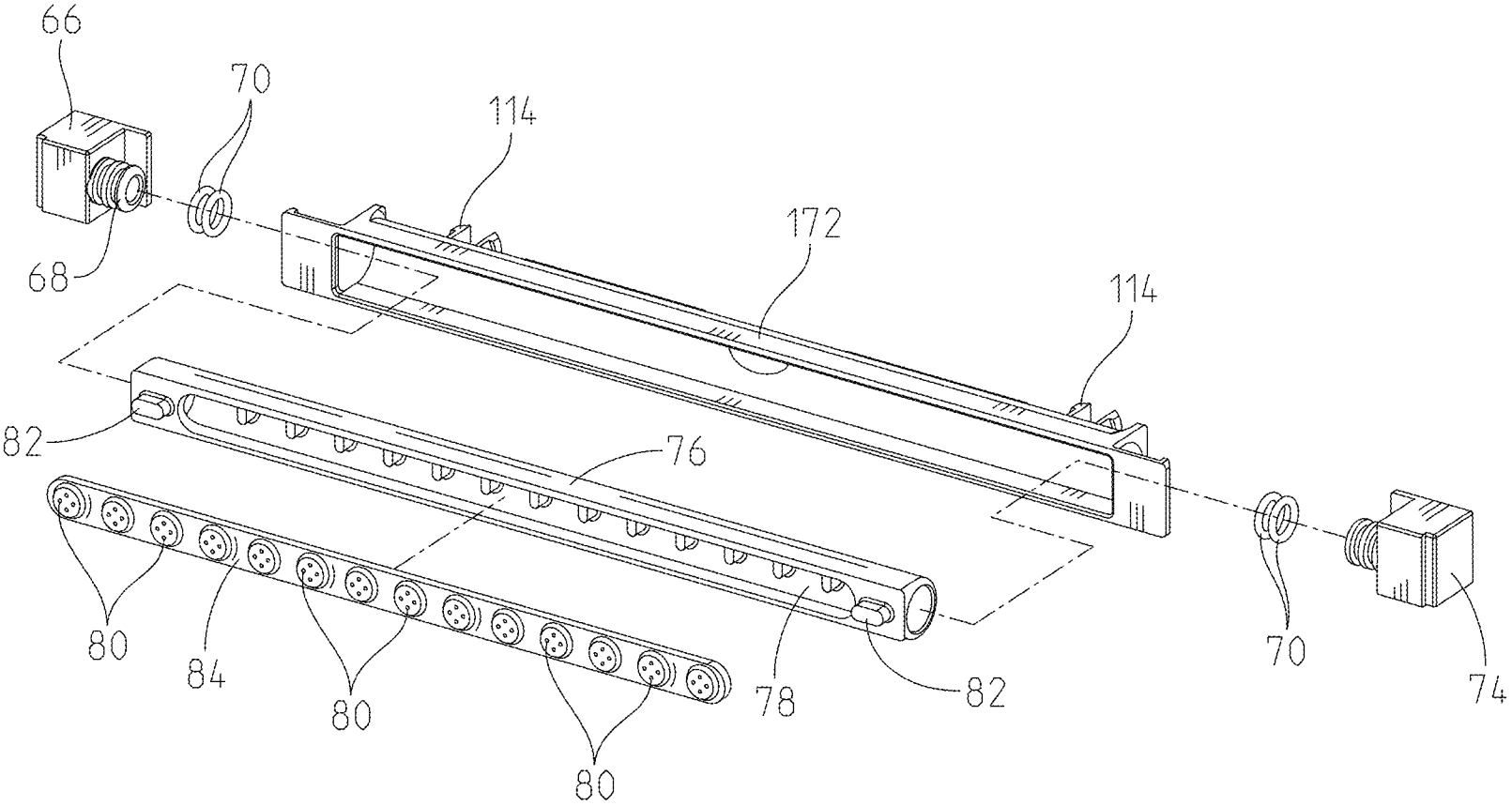
FIG. 11A is an exploded perspective view of the fluid discharge assembly of the illustrative waterfall deckplate of FIG. 8.
Figure 11B:
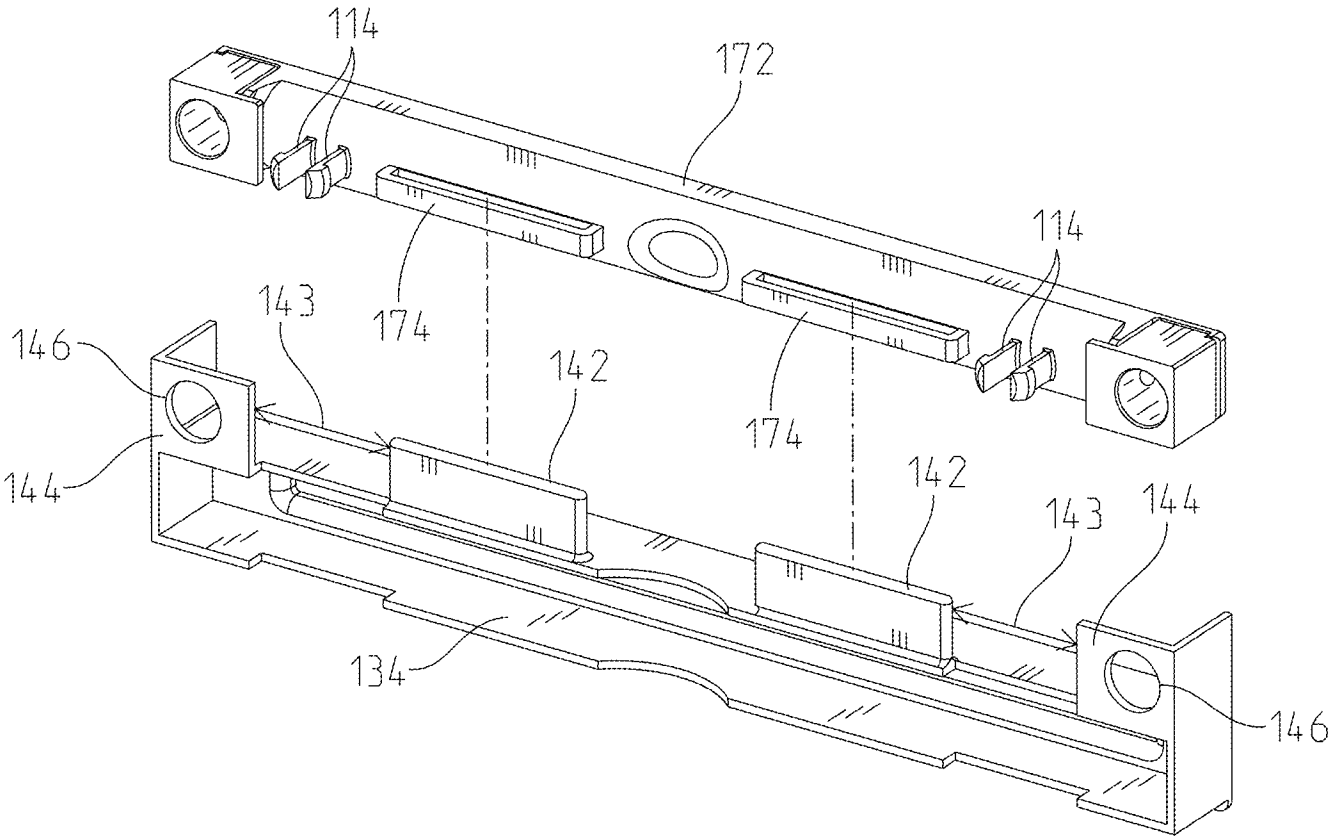
FIG. 11B is an exploded view showing a manifold assembly and cover plate of FIG. 8.

In the illustrated embodiment, manifold body 76 also includes a pair of projecting tabs 82 that a user can engage to rotate manifold body 76 within manifold housing 72 and about the tubular projections of end caps 66, 74. By rotating manifold body 76, the orientation of nozzles 80 can be adjusted whereby the angle at which the fluid being discharged can be adjusted, i.e., directed in a more upward or downward direction depending upon the position of manifold body 76 within manifold housing 72. As shown in FIG. 11A, nozzles 80 may be formed in an inlay 84 that is subsequently attached to manifold body 76, e.g., by friction fit, adhesives or other suitable method.

Figure 12A:
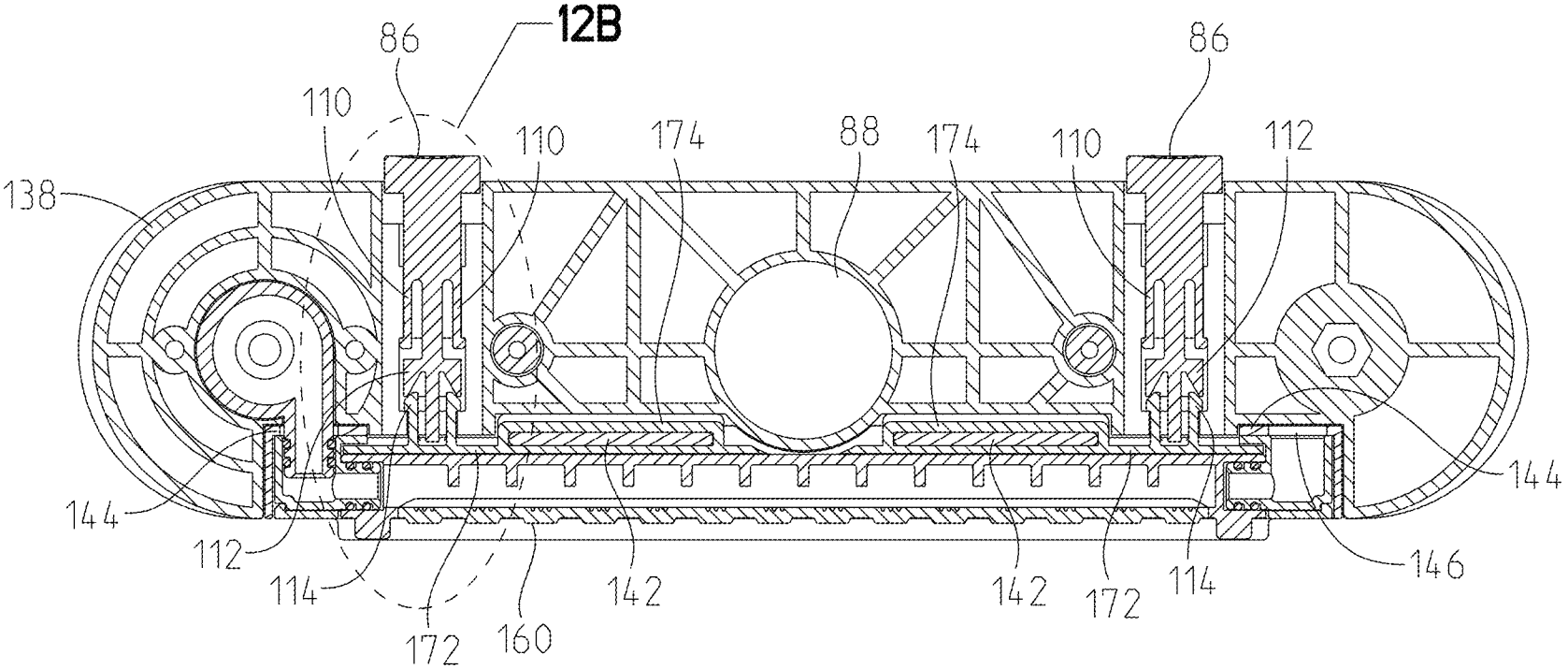
FIG. 12A is a cross-sectional view of the illustrative waterfall deckplate taken along line 12A-12A of FIG. 8.

Latching members 86 are used to secure manifold assembly 60 to framework 38. Latching members 86 include a pair of resiliently flexible barbed tabs 110 wherein barbs 111 extend outwardly from the tabs 110 to engage a ledge 39 on framework 38 whereby latching members 86 can be pushed further into framework 38 but cannot be removed without biasing the barbed tabs 110 inwardly. Latching members 86 also include a camming member 112 for releasing manifold housing 72 from framework 38. Two pair of resiliently flexible barbed prongs 114 extend from the back wall of the manifold housing wherein the barbs project outwardly from the tabs and engage ledges 37 on the framework to thereby retain the manifold assembly on the framework. As best understood with reference FIGS. 12A and 12B, depression of latching members 86 causes the camming member 112 on a latching member 86 to bias a pair of the barbed prongs 114 inwardly to disengage the barbs from the ledge 37 and thereby allow the manifold assembly to be detached from the framework. It is noted that some of the figures depict latching members 86 in a more simplified and schematic form than shown FIGS. 12A and 12B which provide a more detailed view of latching member 86.

Latching members 86 may also be referred to herein as an engagement member 86 and include a user-accessible radially enlarged head 87 that can be depressed by a user to cause camming member 112 of engagement member 86 to disengage the flexible prongs 114 and thereby allow removal of the nozzle manifold from the assembly. Other mechanisms for releasably securing manifold assembly to framework 38 may also be employed, e.g., threaded fasteners, pins and other suitable securement mechanisms.

Figure 1B:
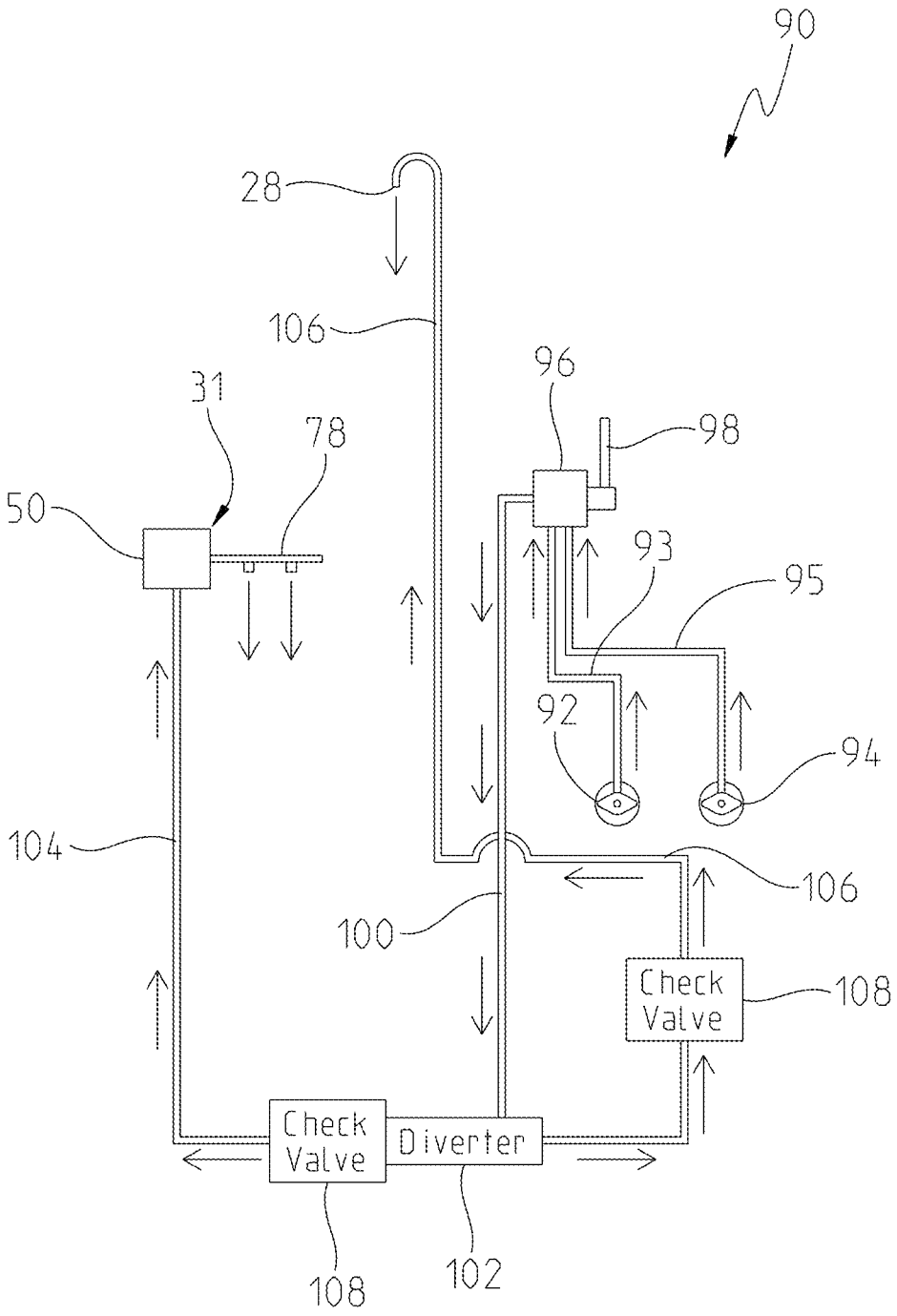
FIG. 1B is a schematic view of the illustrative waterfall deckplate of FIG. 1A.
Figure 2:
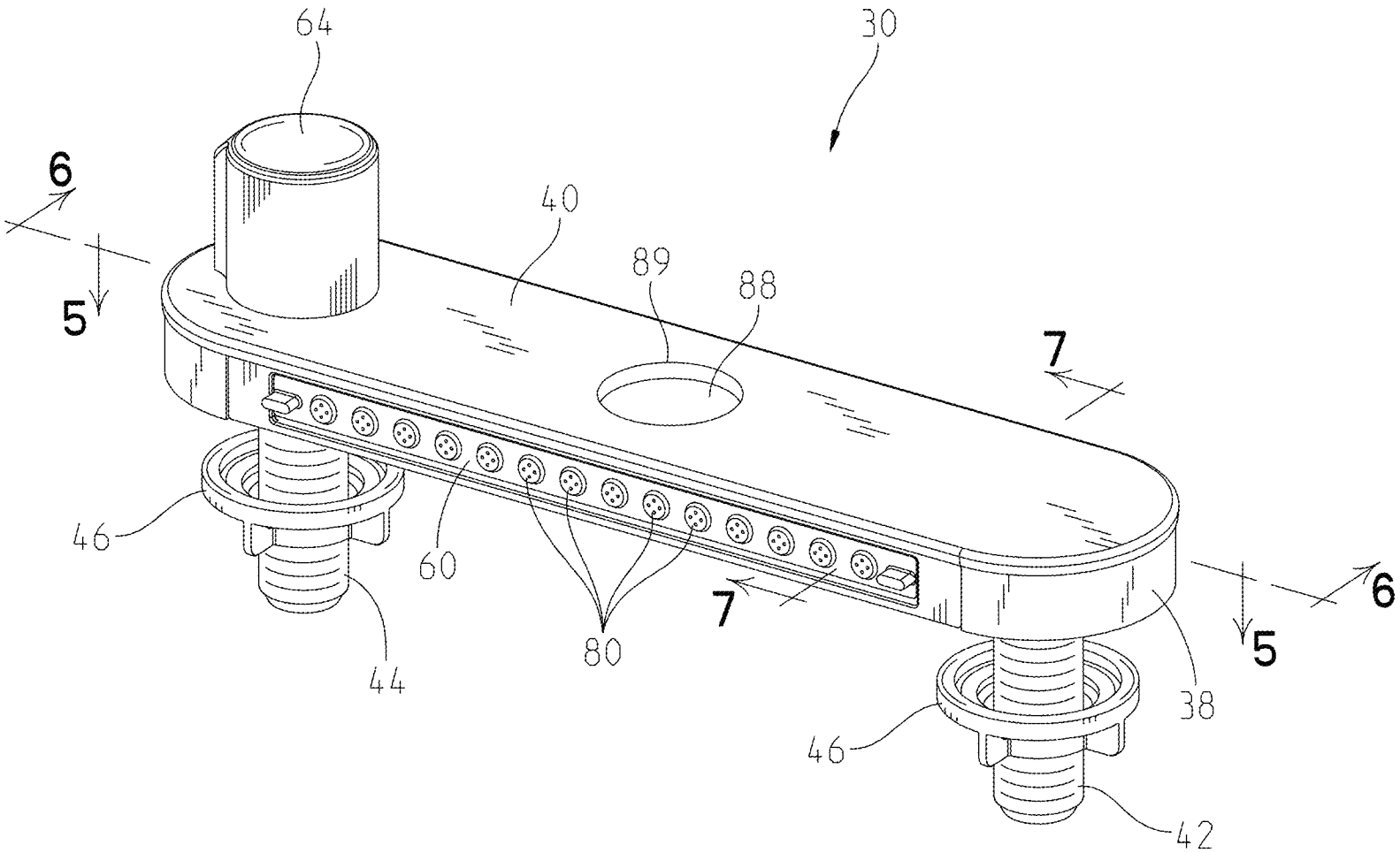
FIG. 2 is a front perspective view of the illustrative waterfall deckplate of FIG. 1A.
Figure 3:
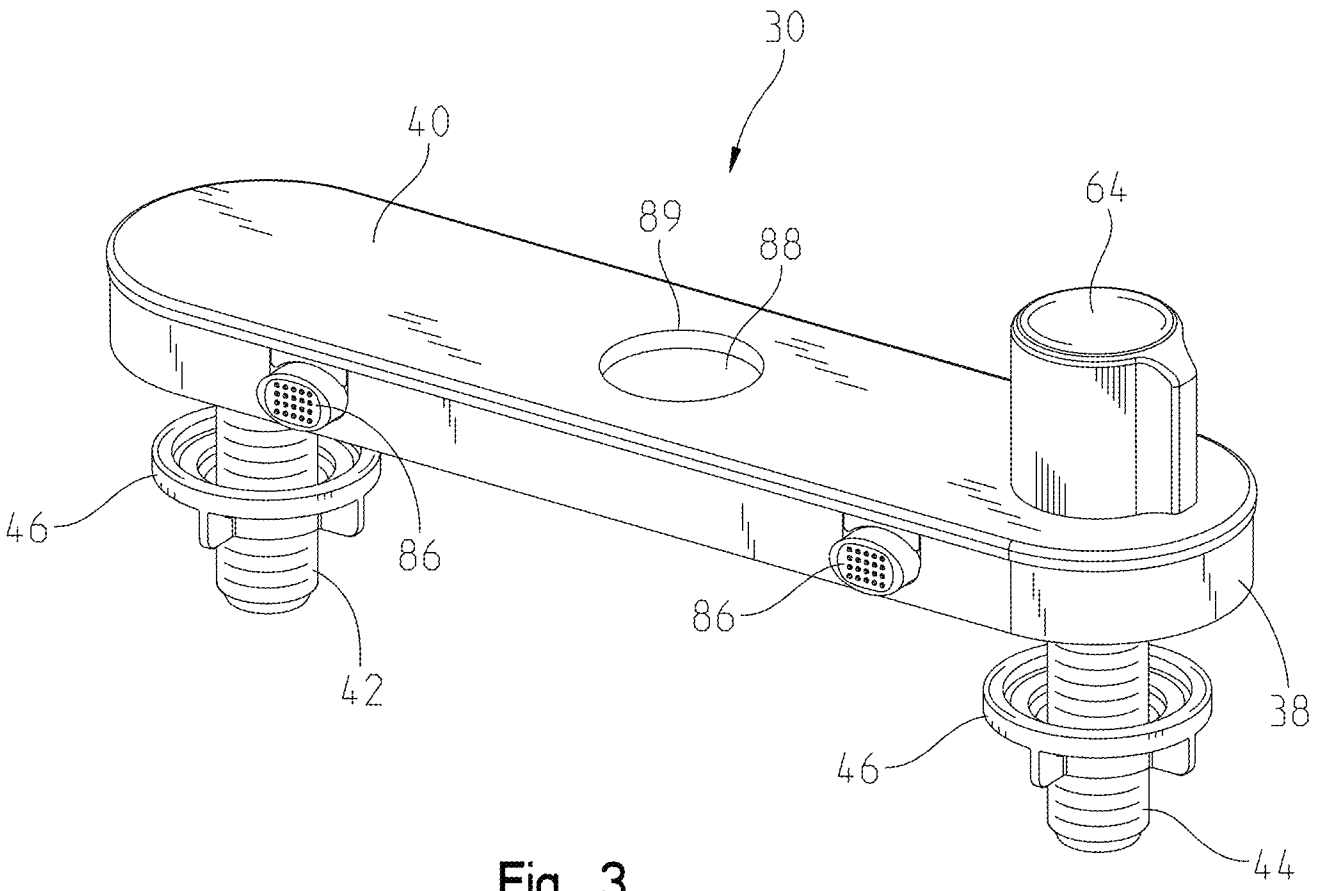
FIG. 3 is a rear perspective view of the illustrative waterfall deckplate of FIG. 2.
Figure 4:
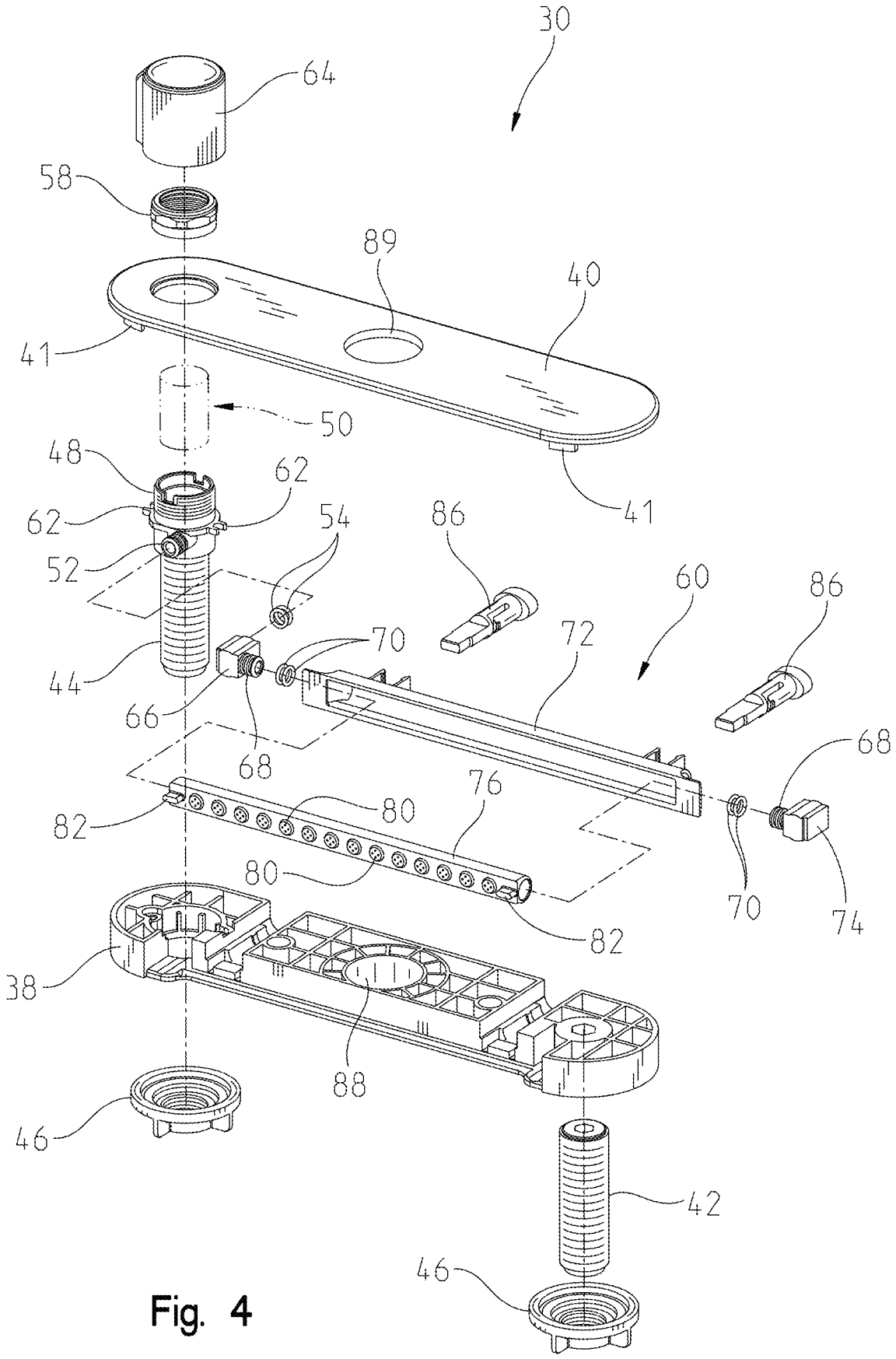
FIG. 4 is an exploded perspective view of the illustrative waterfall deckplate of FIG. 2.
Figure 5:
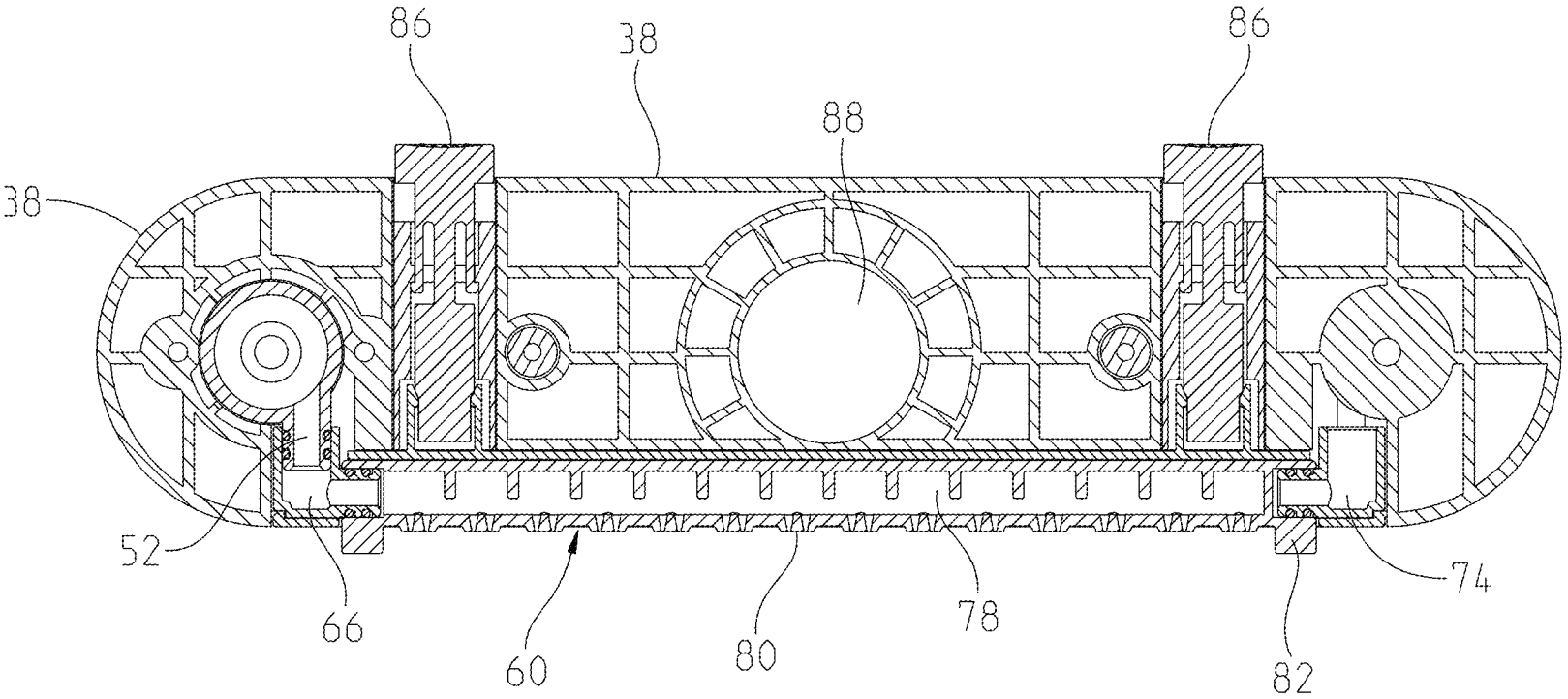
FIG. 5 is a cross-sectional view of the illustrative waterfall deckplate taken along line 5-5 of FIG. 2.
Figure 6:
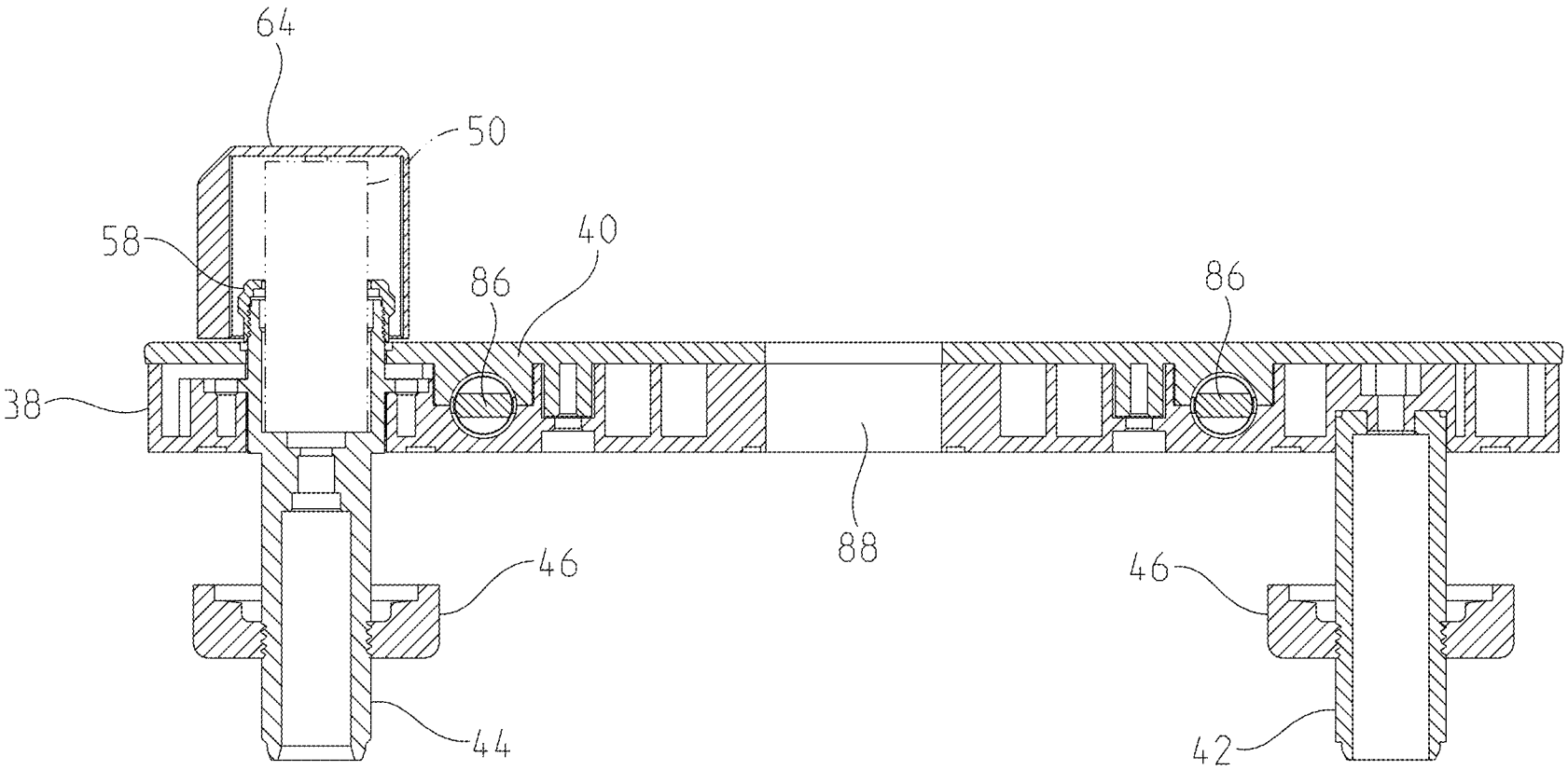
FIG. 6 is a cross-sectional view of the illustrative waterfall deckplate taken along line 6-6 of FIG. 2.
Figure 7:
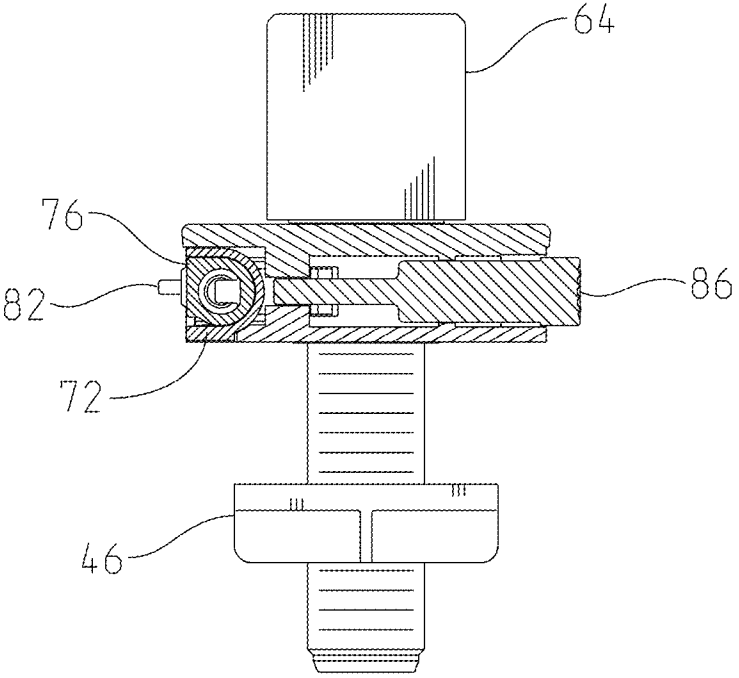
FIG. 7 is a cross-sectional view of the illustrative waterfall deckplate taken along line 7-7 of FIG. 2.
Figure 8:
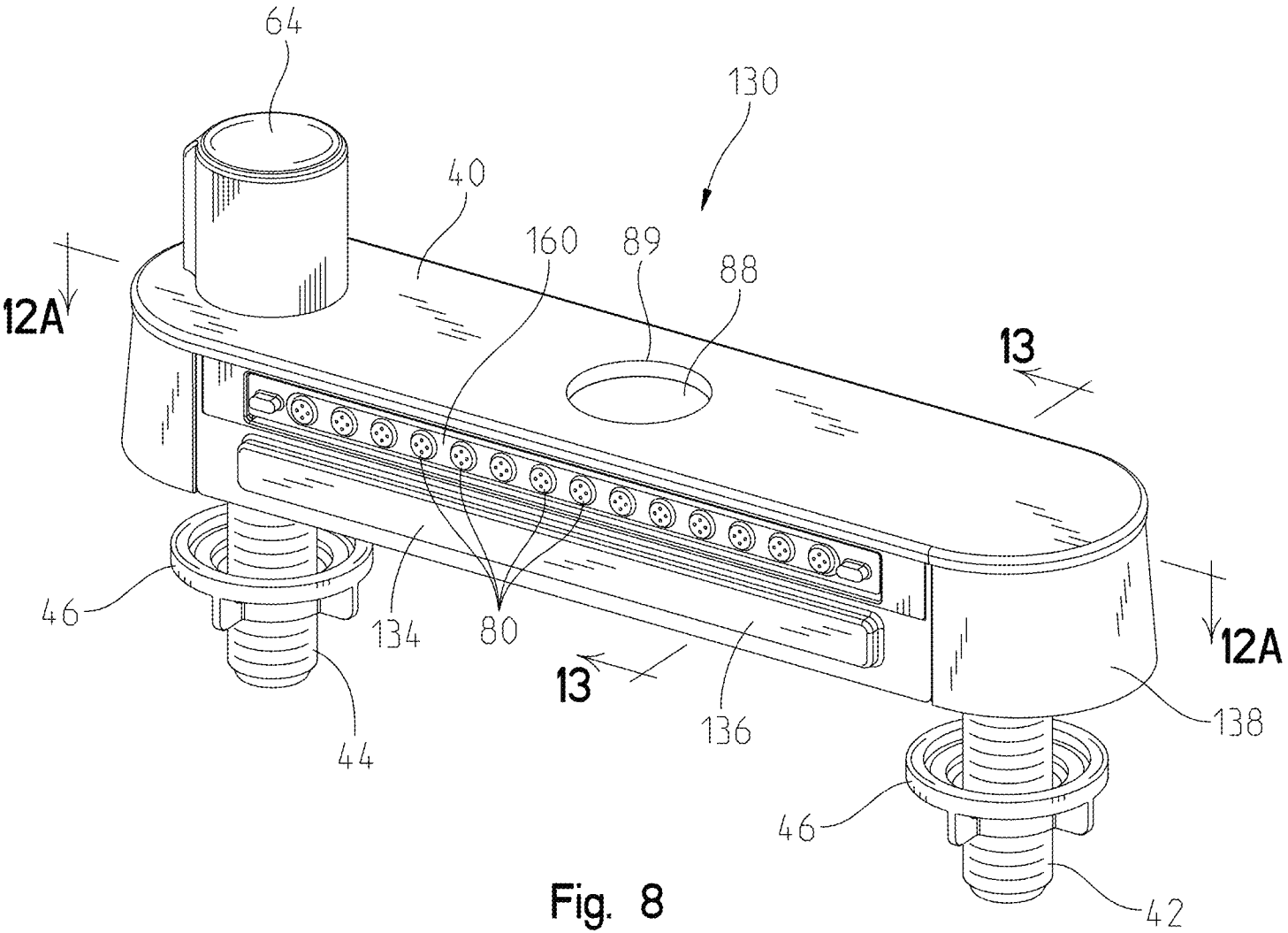
FIG. 8 is a front perspective view of another illustrative waterfall deckplate.
Figure 9:
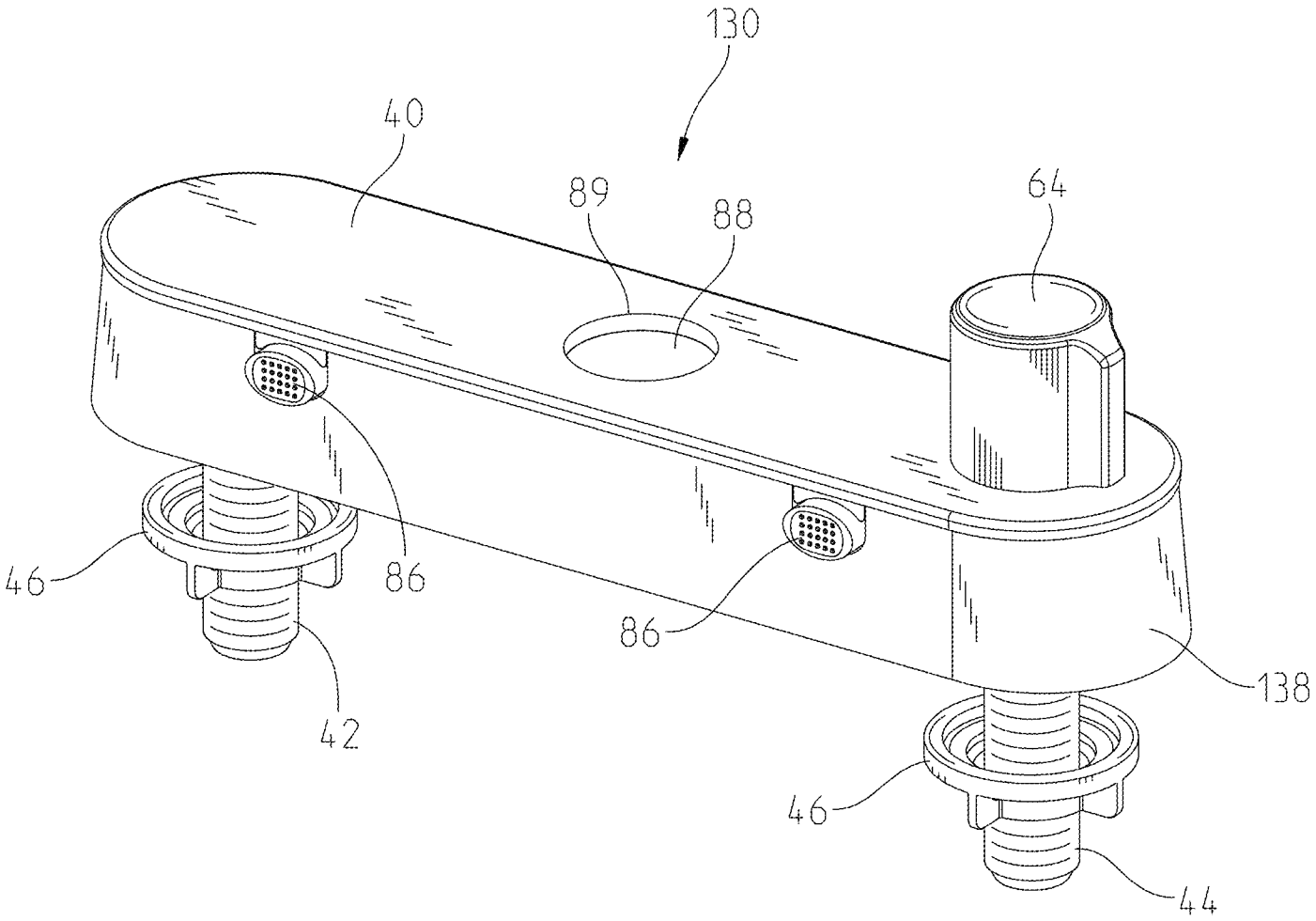
FIG. 9 is a rear perspective view of the illustrative waterfall deckplate of FIG. 8.
Figure 10:
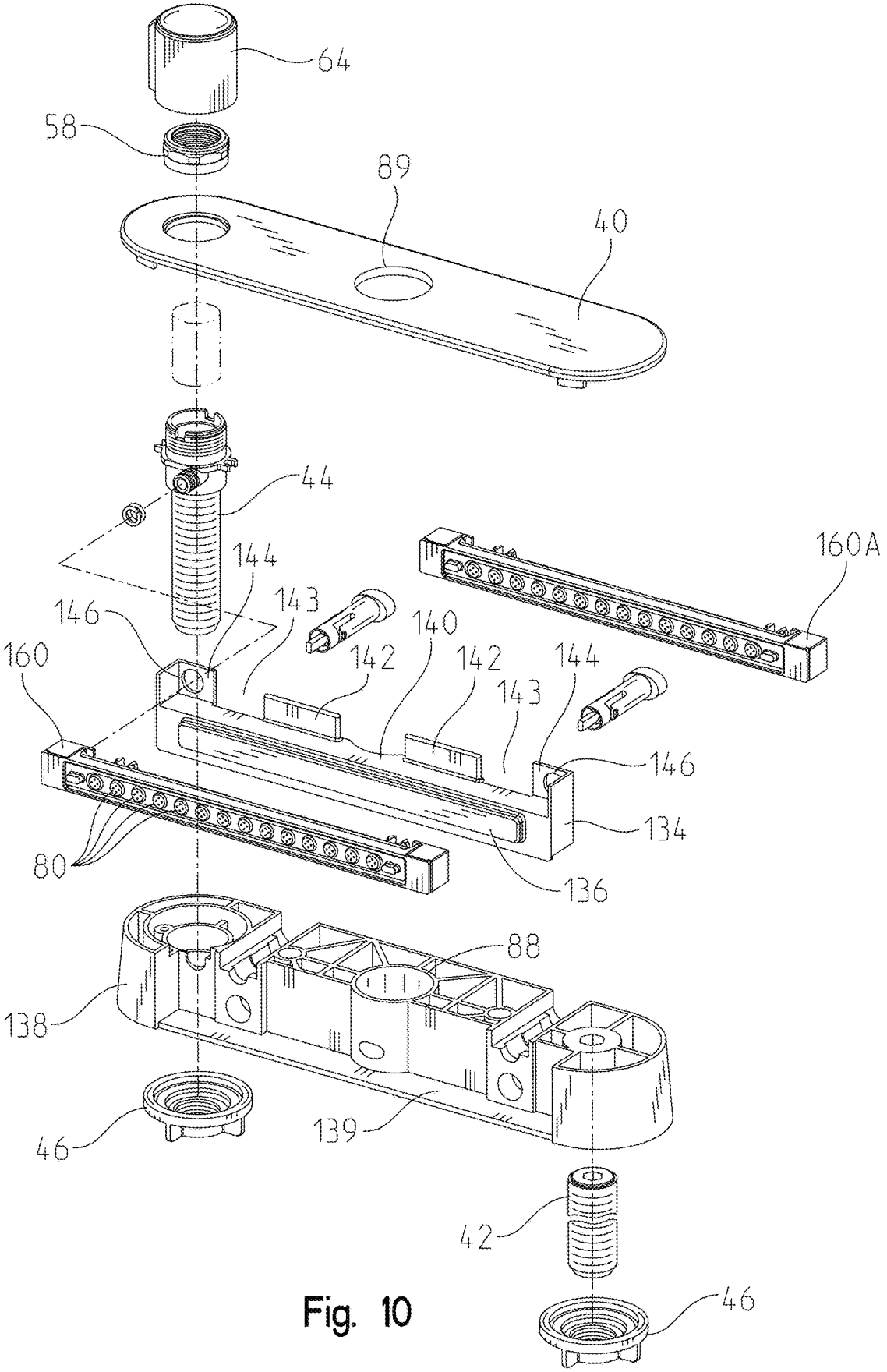
FIG. 10 is an exploded perspective view of the illustrative waterfall deckplate of FIG. 8.

A central opening 88 extends through framework 38 and an aligned central opening 89 is present in cover 40 to facilitate the mounting of faucet 22 on deckplate assembly 30. FIG. 1B provides a schematic diagram of how a faucet assembly 90 including a faucet 22 and deckplate assembly 30 are connected to a fluid supply for operation. In the illustrated embodiment, the faucet assembly 90 is connected to a hot water supply 92 and a cold water supply 94. A fluid line 93 connects hot water supply 92 with a mixing valve 96 disposed in the body of faucet 22. A separate fluid line 95 connects cold water supply 94 with mixing valve 96. Faucet handle 98 is used to adjust mixing valve 96 to adjust the ratio of hot and cold water and thereby adjust the temperature of water discharged from mixing valve 96 into regulated water line 100.

Water line 100 extends from mixing valve 100 to a diverter valve 102. Water then flows from diverter 102 to either deck supply line 104 or faucet supply line 106. Mixing valve 96 and diverter valve 102 are conventional valves as typically used when combining a spray head with a single handle kitchen faucet. An example of such valves is disclosed in U.S. Pat. No. 7,721,761 B2, the entire disclosure of which is hereby incorporated herein by reference. Check valves 108 are arranged in fluid lines 104, 106 to prevent the flow of fluid from lines 104, 106 into diverter 102.

During operation of faucet assembly 90, handle 98 is used to turn the water flow on and off and regulate the temperature of the water dispensed from either faucet outlet 28 or nozzles 80. To dispense water from faucet outlet 28, handle 98 is used to open control valve 96, which in the illustrated embodiment is a mixing valve, and control valve 50 is closed. The relative pressures acting on the spool element in diverter valve 102 will move the spool element to a position that diverts fluid from line 100 to line 106 where it will be discharged from faucet outlet 28. Opening valve 50 while valve 96 is also open will result in the fluid pressure moving spool element to a position where water from line 100 is diverted to line 104 where it flows to manifold assembly 60 and is discharged from the plurality of nozzles in a waterfall discharge.

In an alternative embodiment, instead of using a control valve 50 that only opens and closes to allow or deny the passage of fluid therethrough, a mixing valve could be used to provide the control valve for the manifold assembly 60. In such an embodiment, both hot and cold water lines would be connected to the mixing valve forming control valve 50. Both hot and cold water lines would also be connected to the mixing valve in the faucet 22 whereby water could be simultaneously dispensed from both faucet outlet 28 and nozzles 80 and the temperature of the water discharged from the faucet outlet 28 could be adjusted independently of the temperature of the water being discharged from nozzles 80. In such an alternative embodiment, a diverter valve would not be required. The illustrative embodiment of FIGS. 15-21, provides an example of such an alternative embodiment having a mixing valve which is supplied by both a hot water line and a cold water line.

A second illustrated embodiment of a waterfall deckplate assembly 130 is shown in FIGS. 8-10, 12A, 12B and 13. The waterfall deckplate assembly 130 includes many similar features as the waterfall deckplate assembly 30 detailed above. As such, in the following description duplicative parts are not discussed in detail and similar components are identified with like reference numbers.

This waterfall deckplate assembly 130 is similar to the first embodiment assembly 30, but the framework 138 of the second embodiment has a greater height to define a storage compartment 132 for a spare manifold assembly 160A and the manifold assembly 160 that is in fluid communication with fluid line 104 is positioned at a greater height above the horizontal support surface. The spare manifold may be identical to manifold 160 and act simply as a spare part in case manifold assembly 160 fails, or, it may include nozzles having a different spray pattern whereby the two manifolds can be interchangeably installed in the deckplate assembly to provide the desired spray pattern. As mentioned earlier, manifold assemblies 160, 160A are identical to manifold assembly 60 except for the addition of a pair of brackets 174 on the rear wall of manifold housing 172.

Framework 138 has a bottom lip 139 on which spare manifold assembly 160A is positioned. Cover plate 134 is then positioned to trap manifold assembly 160A on lip 139 with the lower section 136 of cover plate 134 covering assembly 160A. Cover plate 134 also defines a horizontal shelf surface 140 on which manifold assembly 160 is mounted. Both manifold assembly 160 and 160A have the same design as manifold assembly 60 and manifold assembly 160 is coupled with extension 52 to communicate fluid to the internal passage of manifold assembly 160 while it is mounted on shelf 140.

Cover plate 134 also includes back wall sections 144 located proximate the opposite ends of cover plate 134 and openings 146 in back wall sections 144 allow extension 52 to extend therethrough to engage manifold assembly 160. Cover plate 134 also includes more centrally located back wall sections 142 that are inserted into brackets 174 on the manifold housing 172 of manifold assembly 160 to thereby help secure cover plate 134 on framework 138. Gaps 143 are formed between back wall sections 142 and 144 to allow barbed prongs 114 to engage framework 138. By depressing latching members 86 to release barbed prongs 114 from framework 138 and disengaging manifold assembly 160 from extension 52, manifold assembly 160 and cover plate 134 can be removed from framework 138. Once manifold assembly 160 and cover plate 134 are removed, the spare manifold assembly 160A can be removed from storage compartment 132.

Figure 14:
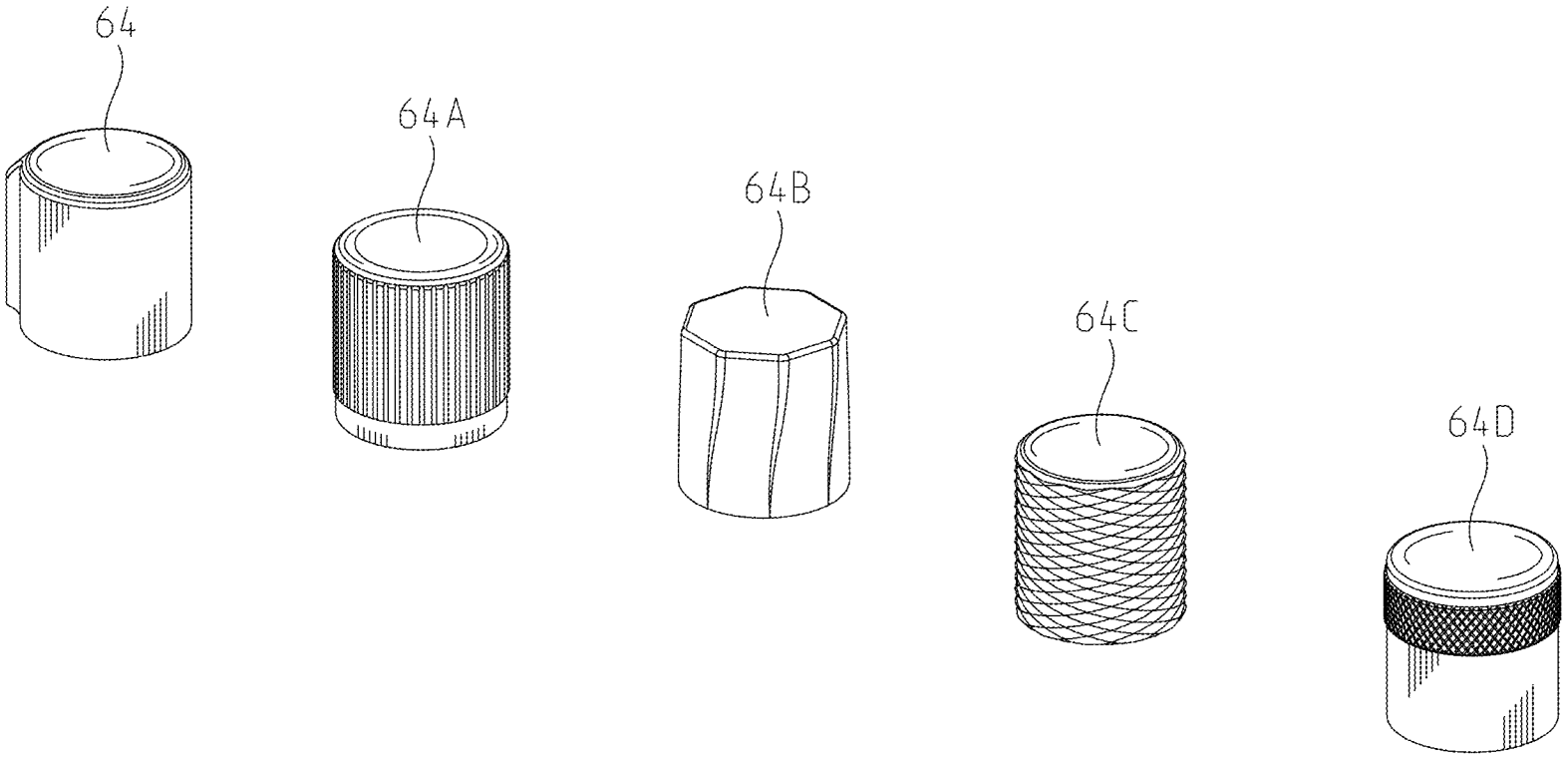
FIG. 14 are perspective views of various control knobs for use with the illustrative waterfall deckplates illustrated herein.

Turning to FIG. 14, a plurality of interchangeable knobs 64 and 64A-64D that can be mounted on a control valve 50 are shown. Each of these plurality of user operable actuators have a different exterior appearance whereby an appearance that matches the faucet associated with the deckplate assembly can be chosen.

Figure 15:
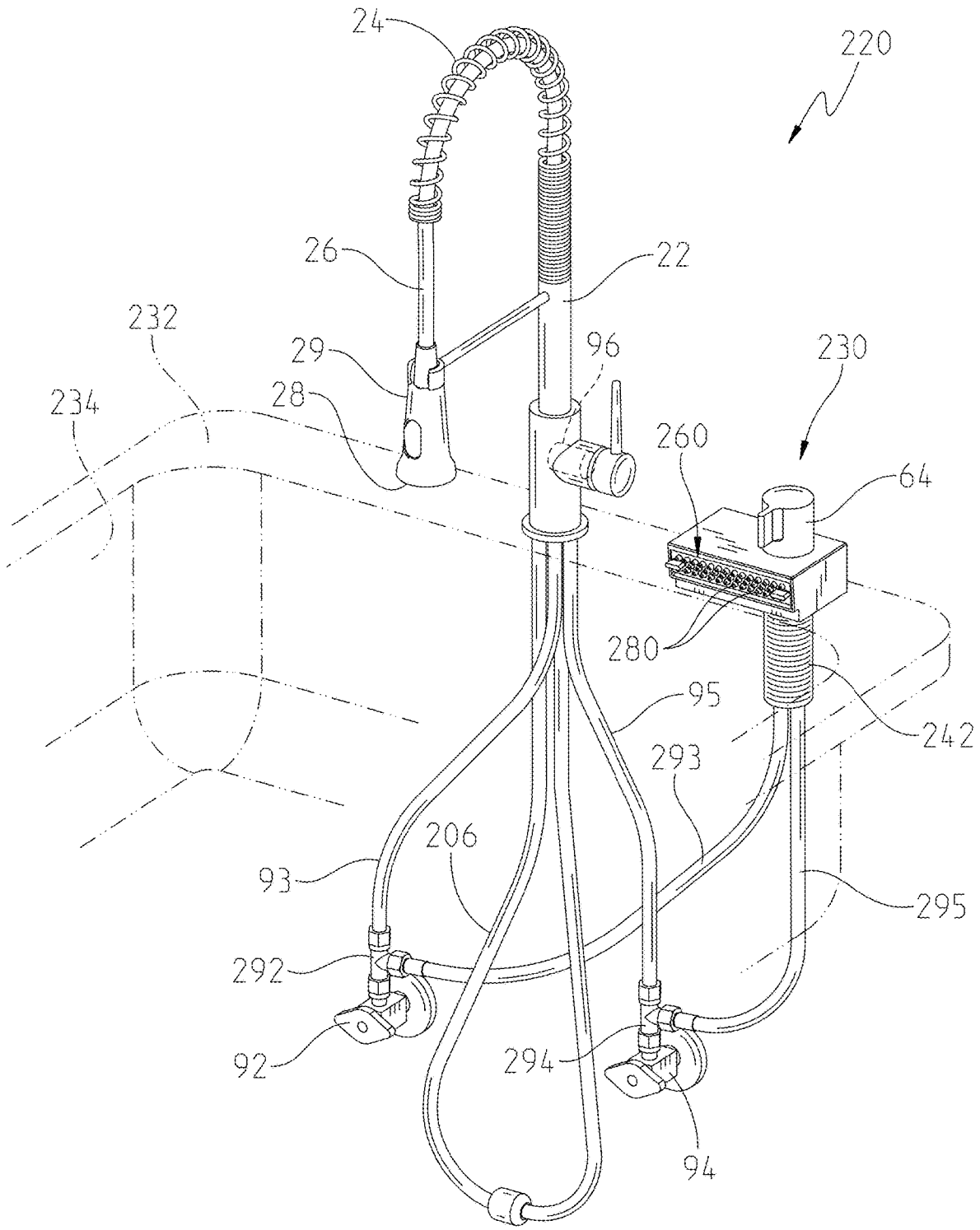
FIG. 15 is a perspective view of another illustrative waterfall deckplate assembly and faucet.
Figure 16:
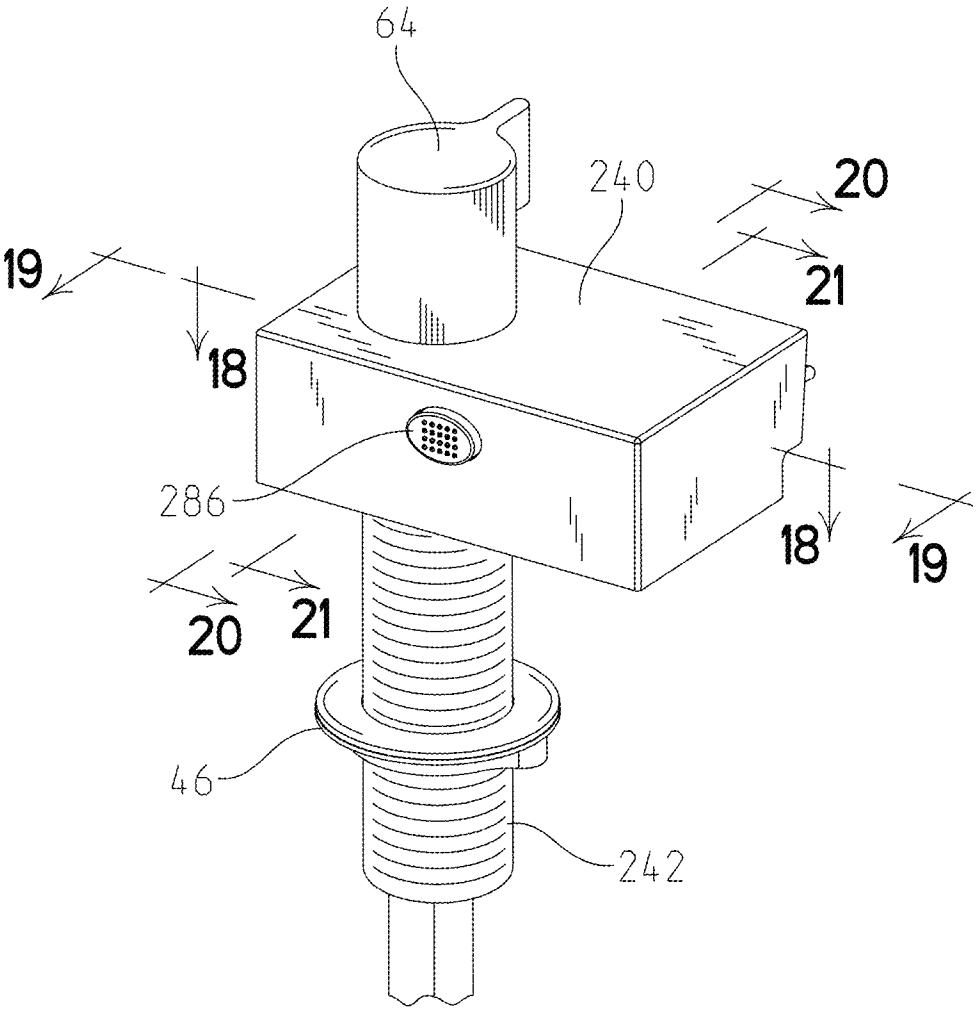
FIG. 16 is a rear perspective view of the deckplate assembly of FIG. 15.
Figure 17:
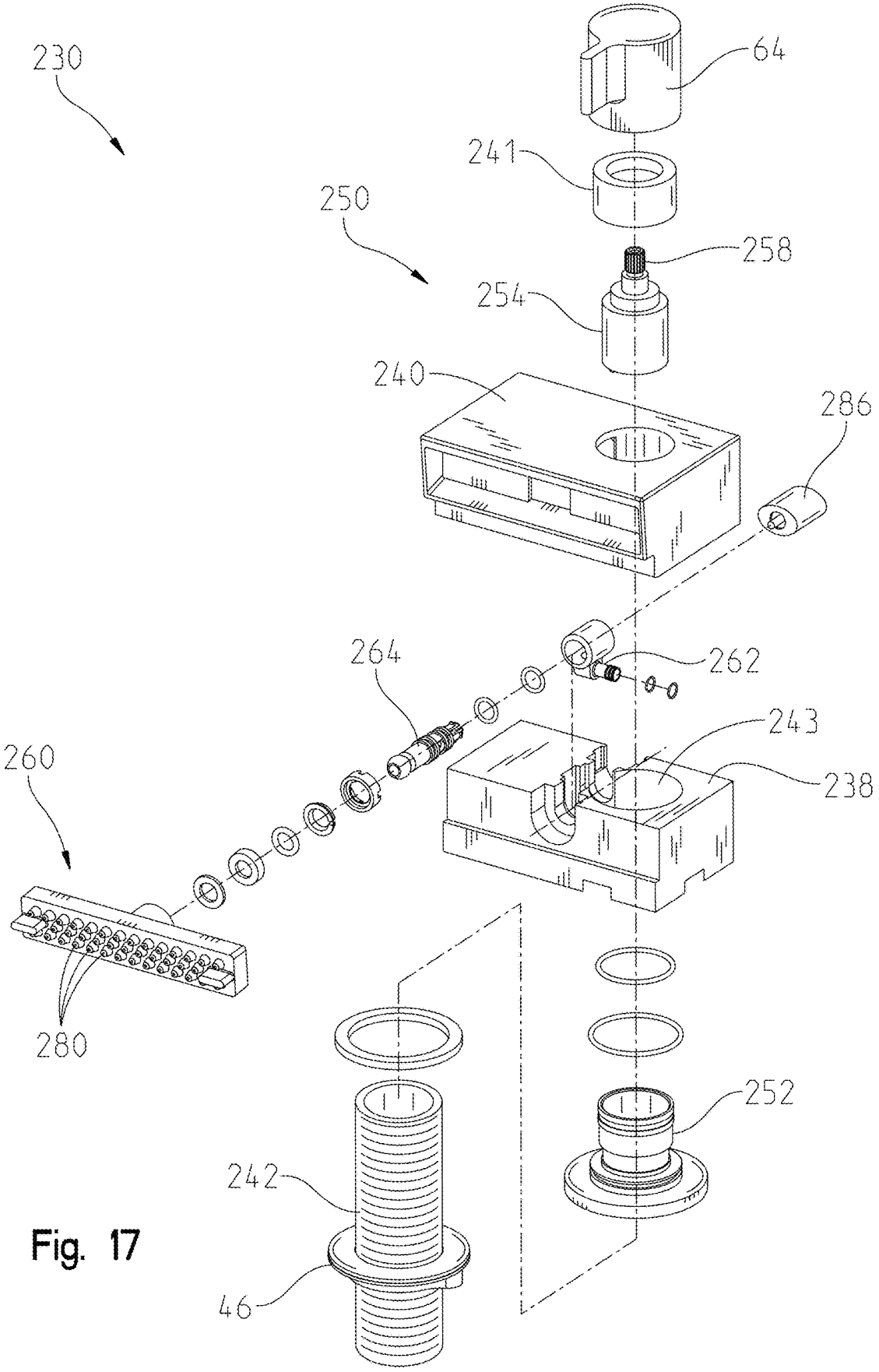
FIG. 17 is an exploded view of the deckplate assembly of FIG. 15.
Figure 18:
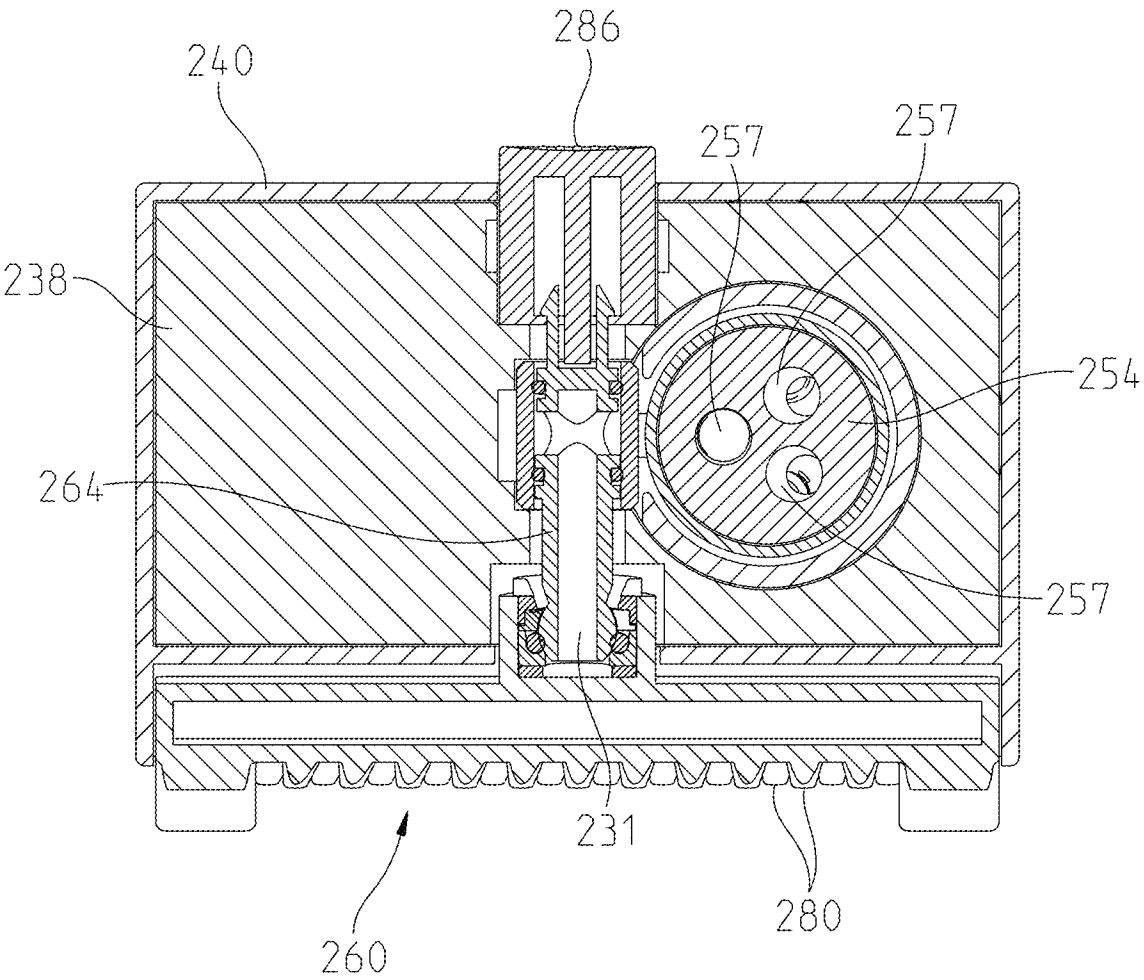
FIG. 18 is a cross-sectional view taken along line 18-18 of FIG. 16.
Figure 19:
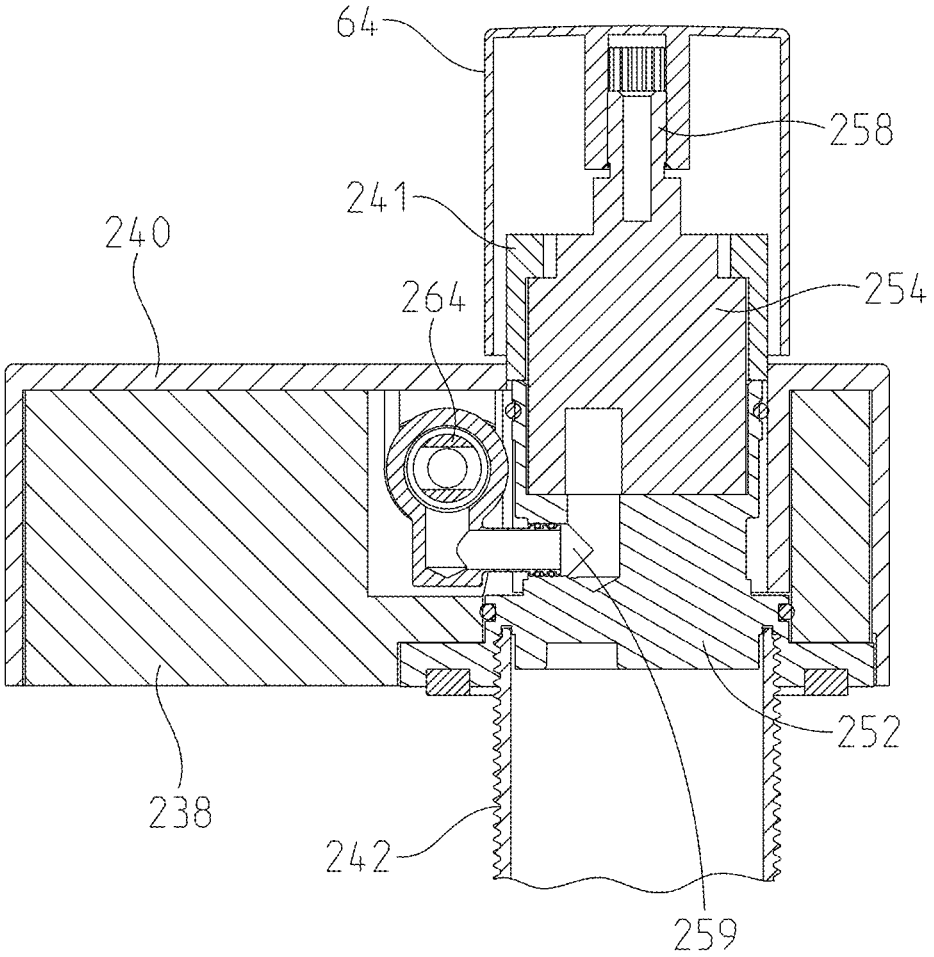
FIG. 19 is a cross-sectional view taken along line 19-19 of FIG. 16.

FIGS. 15-23 illustrate another embodiment of a faucet assembly 220. The faucet assembly 220 of this illustrative embodiment includes a faucet 22 and a waterfall deckplate assembly 230. While waterfall deckplate assemblies 30, 130 of FIGS. 1A and 8 include deckplate structures defining an opening 88, 89 with the faucet 22 being mountable on the deckplate structure at the opening 88, 89, waterfall deckplate assembly 230 is adapted to be mounted proximate faucet 22 whereby both waterfall deckplate assembly 230 and faucet 22 discharge fluid into a common basin 234 with the faucet 22 being mounted separately and spaced apart from the deckplate assembly 230 as shown in FIG. 15.

It is noted that the construction and function of waterfall deckplate assembly 230 is generally the same as assemblies 30, 130. As such, in the following description duplicative parts are not discussed in detail and similar components are identified with like reference numbers.

In the illustrative embodiment of FIG. 15, both faucet 22 and waterfall deckplate assembly 230 are mounted directly on sink deck or rim 232 at locations where an opening is located in the sink rim 232, whereby water lines 93, 95 and 293, 295 may be routed separately to faucet 22 and waterfall deckplate assembly 230, respectively, from underneath sink basin 234 through openings in sink rim 232. In this regard, it is noted that many standard sink fixtures include both faucet openings and accessory (e.g., side sprayer or sprayhead) openings. Faucet 22 may be mounted using the standard faucet openings, while waterfall deckplate assembly 230 can be mounted over an opening adapted to receive a conventional side sprayer or sprayhead and thereby replace the conventional side sprayer.

Waterfall deckplate assembly 230 functions similarly to waterfall deckplate assemblies 30, 130 discussed above and includes a knob 64 for manipulating a user operable control valve 250 which is operable to selectively allow fluid flow to the discharge nozzles 280 of manifold assembly 260.

In contrast to the embodiment of FIG. 1A, waterfall deckplate assembly 230 shown in FIG. 15 is not connected downstream of a diverter valve 102, but instead includes the control valve 250 that functions as a mixing valve and is connected to both the hot water supply 92 and the cold water supply 94.

As can be seen in FIG. 15, T-fittings 292, 294 are respectively connected to the hot water supply 92 and cold water supply 94. Water line 93 supplies hot water from T-fitting 292 to the mixing valve 96 of faucet 22, while water line 95 connected to T-fitting 294 supplies cold water to the mixing valve 96 of faucet 22. A faucet supply line 206 runs from the mixing valve 96 of faucet 22 to the discharge outlet 28 of faucet 22. The extra length of supply line 206 allows the sprayhead 29 of faucet 22 to be detached from its support clip or nest, as will be understood by those having ordinary skill in the art.

A hot water supply line 293 and T-fitting 292 couple hot water supply 92 to waterfall deckplate assembly 230, while a cold water supply line 295 and T-fitting 294 couple cold water supply 94 to waterfall deckplate assembly 230.

Figure 20:
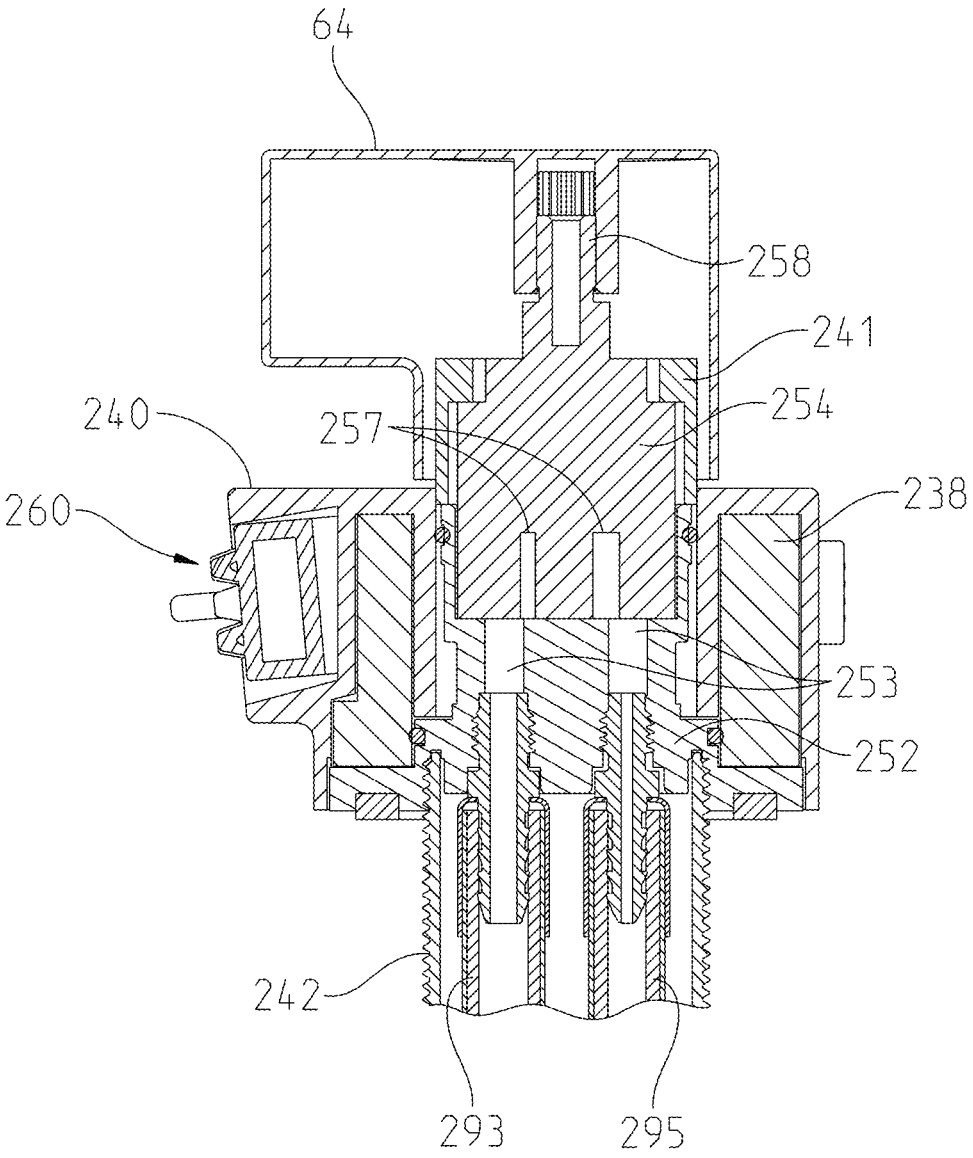
FIG. 20 is a cross-sectional view taken along line 20-20 of FIG. 16.
Figure 21:
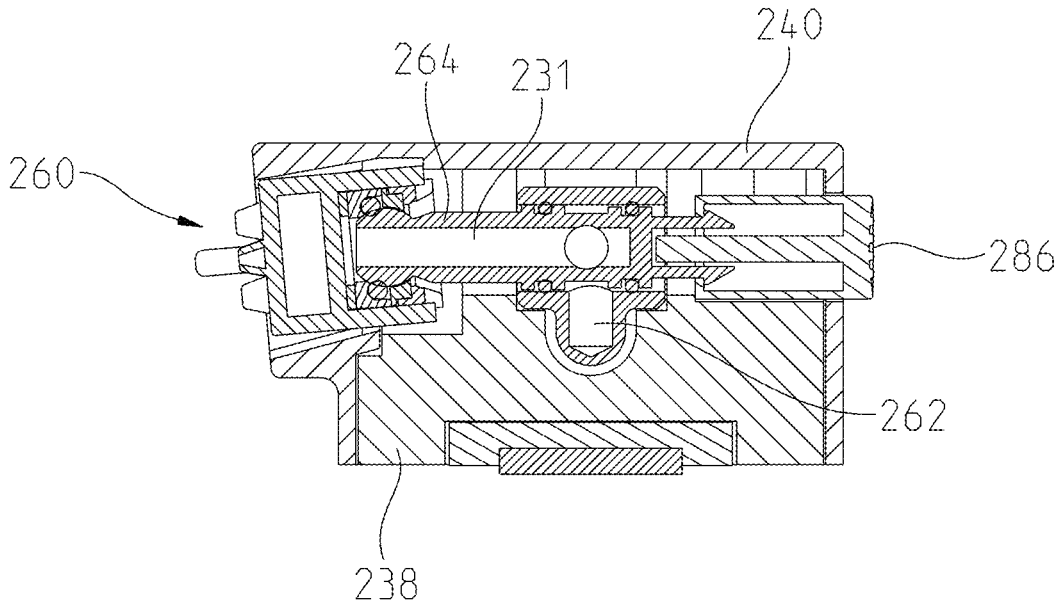
FIG. 21 is a cross-sectional view taken along line 21-21 of FIG. 16.
Figure 22:
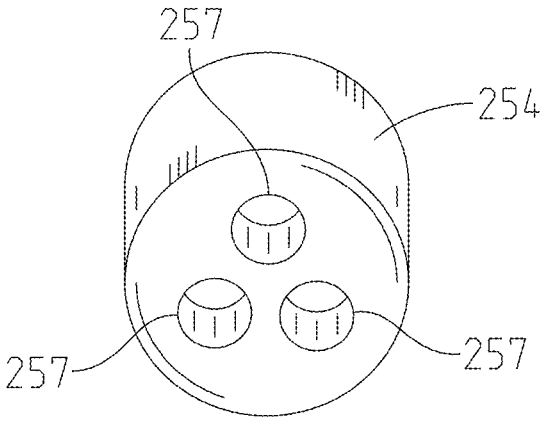
FIG. 22 is schematic perspective view of an upper valve body of the waterfall deckplate assembly of FIG. 15.
Figure 23:
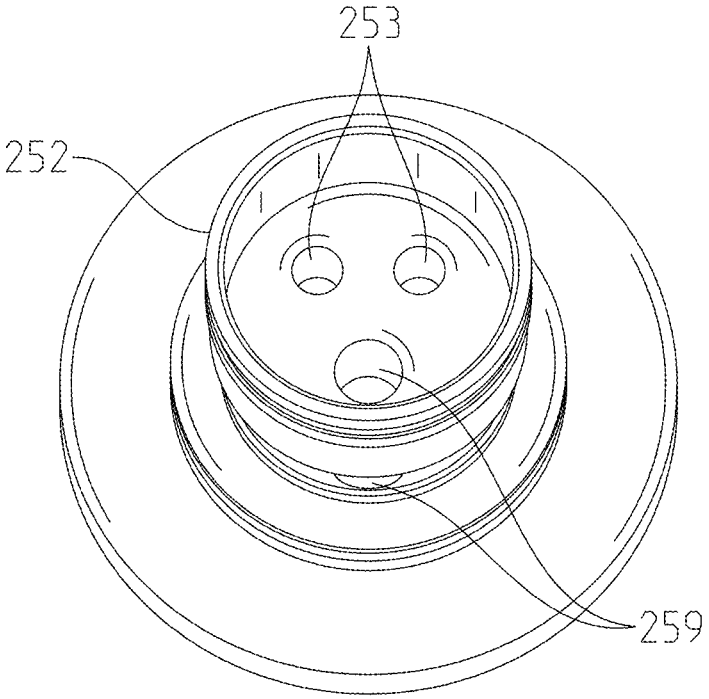
FIG. 23 is a schematic perspective view of a lower valve body of the waterfall deckplate assembly of FIG. 15.

As can be seen in FIG. 20, hot water supply line 293 and cold water supply line 295 extend through the hollow body of attachment post 242 and are attached to inlet bores 253 in lower valve member 252. An upper valve member 254 is engaged with lower valve member 252 and is rotated relative to lower valve member 252 by rotating a knob 64 attached to the stem 258 of upper valve member 254. The mixing valve 250 is illustratively supported within a base or framework 238. A cover 240 receives, and is positioned above, the framework 238. A retainer, such as a mounting nut 241, may secure the mixing valve 250 within an opening 243 of the framework 238.

As upper valve member 254 is rotated relative to lower valve member 252, passages 257 in upper valve member 254 act to open and close the inlet bores 253 in lower valve member 252 and regulate the flow of water to outlet passage 259 in lower valve member 252.

It is noted that mixing valve 250 is depicted in simplified form and a wide variety of different mixing valves (including cycling valves) well-known in the art can be used with waterfall deckplate assembly 230. For example, the mixing valves disclosed in U.S. Pat. No. 7,753,074 to Rosko et al., U.S. Pat. No. 8,469,056 to Marty et al. and U.S. Pat. No. 8,375,990 to Veros, the disclosures of which are hereby incorporated herein by reference, could be adapted for use with waterfall deckplate assemblies disclosed herein.

As those having ordinary skill in the art will recognize, a mixing valve such as valve 250 can be used to stop and start water flow through the valve, and regulate the temperature and/or flow rate of the water flow discharged from the valve when the valve is connected to both hot water source 92 and cold water source 94.

Valve 250 is part of the fluid conveyance system 231 of assembly 230 and from valve 250, the discharged water flows through a lateral extension 262 and spindle connector 264 to manifold assembly 260 where the water is discharged through a plurality of nozzles 280. O-rings and flat sealing washers are illustratively used to prevent the leakage of fluid in assembly 230 as will be readily understood by those with ordinary skill in the art.

Figure 12B:
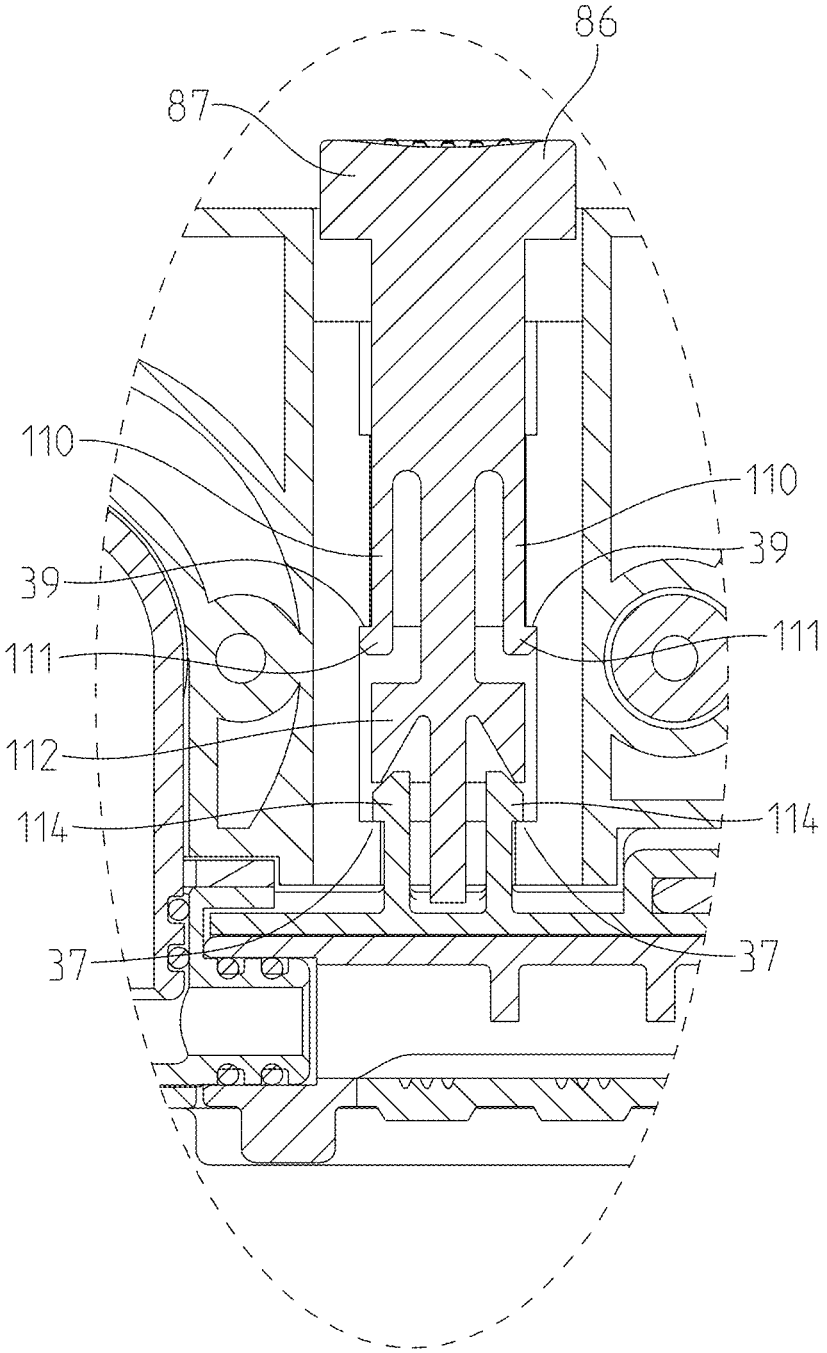
FIG. 12B is a detail view of a portion of FIG. 12A.
Figure 13:
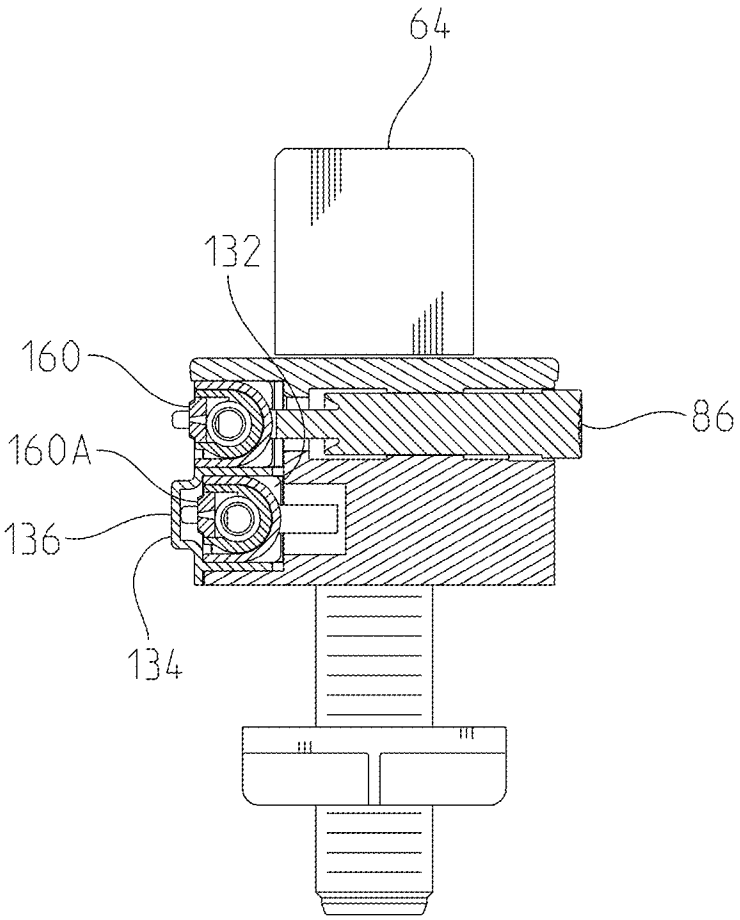
FIG. 13 is a cross-sectional view of the illustrative waterfall deckplate taken along line 13-13 of FIG. 8.

Manifold assembly 260 is secured to waterfall deckplate assembly 230 with latching members 286. Latching members 286 are similar to and function similar to latching members 86 however, latching members 286 are represented in simplified form in the figures and to further understand how latching members 286 releasably secure manifold assembly 260 reference should be made to latching members 86 as depicted in FIG. 12B and as discussed above.

In alternative embodiments, waterfall deckplate assembly 230 can be attached downstream of a diverter valve similar to assembly 30 as shown in FIG. 1A. When used with a diverter valve, mixing valve 250 can be replaced with a ball valve or other form of valve that simply stops and starts the flow of fluid therethrough.

The smaller size of deckplate assembly 230 with its mounting location being separate from and spaced apart from faucet 22 provides certain advantages. For example, it allows a homeowner having an installed faucet with separate sprayhead to remove the sprayhead and replace it with a waterfall deckplate assembly 230 without having to replace or even detach and reinstall their existing faucet. This facilitates the easy and convenient upgrading of a faucet/sprayhead combination into a faucet and waterfall combination.

Although the invention has been described in detail with reference to certain preferred embodiments, variations and modifications exist within the spirit and scope of the invention as described and defined in the following claims.

What is claimed is:

1. A waterfall deckplate assembly comprising:

a deckplate structure adapted to be mounted on a horizontal surface; and a fluid conveyance system coupled with deckplate structure, the fluid conveyance system adapted to be connected to a fluid supply and including:

a plurality of discharge nozzles supported by the deckplate structure wherein the plurality of discharge nozzles are horizontally aligned when the deckplate structure is mounted on the horizontal surface;

a user operable control valve wherein the control valve is operable to selectively allow fluid flow to the discharge nozzles and prevent fluid flow to the discharge nozzles; and wherein the waterfall deckplate assembly is adapted to be mounted proximate a faucet whereby both the waterfall deckplate assembly and the faucet discharge fluid into a common basin with the faucet being mounted separately and spaced apart from the deckplate assembly.

2. The waterfall deckplate assembly of claim 1, wherein the control valve is a positioned downstream of a mixing valve adapted to be coupled with a hot water supply and a cold water supply and a diverter valve is disposed between the mixing valve and the control valve, the diverter valve being couplable with the faucet.

3. The waterfall deckplate assembly of claim 1, wherein the plurality of discharge nozzles are adjustable nozzles.

4. The waterfall deckplate assembly of claim 1, wherein the control valve includes a user operable actuator projecting above the deckplate structure for operating the control valve.

5. The waterfall deckplate assembly of claim 4, comprising a plurality of user operable actuators interchangeably installable on the control valve, each of the plurality of user operable actuators having a different exterior appearance.

6. The waterfall deckplate assembly of claim 1, wherein the plurality of discharge nozzles are disposed on a first nozzle manifold and the assembly includes a second plurality of discharge nozzles disposed on a second nozzle manifold, the first and second nozzle manifolds being interchangeably installable in the fluid conveyance system; and wherein the deckplate structure defines a storage compartment whereby one of the first and second nozzle manifolds not installed in the fluid conveyance system is storable in the storage compartment.

7. The waterfall deckplate assembly of claim 1, wherein the plurality of discharge nozzles are disposed on a nozzle manifold wherein the nozzle manifold includes at least one flexible prong for engaging the assembly and thereby securing the nozzle manifold to the assembly and wherein the assembly includes a user-accessible engagement member wherein manual manipulation of the engagement member disengages the at least one flexible prong and thereby allows removal of the nozzle manifold from the assembly.

8. The waterfall deckplate assembly of claim 1, wherein the control valve is a mixing valve adapted to be coupled with a hot water supply and a cold water supply.

9. A waterfall deckplate assembly comprising:

a deckplate structure adapted to be mounted on a horizontal surface;

a first plurality of discharge nozzles disposed on a first nozzle manifold and a second plurality of discharge nozzles disposed on a second nozzle manifold;

a fluid conveyance system coupled with deckplate structure, the fluid conveyance system being couplable with a selected one of the first nozzle manifold and the second nozzle manifold, and wherein the fluid conveyance system is connectable to a fluid supply to thereby convey fluid to the selected one of the first nozzle manifold and the second nozzle manifold coupled with the fluid conveyance system;

a user operable control valve disposed in the fluid conveyance system wherein the control valve is operable to selectively allow fluid flow to the discharge nozzles and prevent fluid flow to the discharge nozzles; and wherein the first nozzle manifold and the second nozzle manifold are interchangeably couplable to the fluid conveyance system and the deckplate structure defines a storage compartment whereby a non-coupled one of the first nozzle manifold and the second nozzle manifold is storable in the storage compartment.

10. The waterfall deckplate assembly of claim 9, wherein the plurality of discharge nozzles of the nozzle manifold coupled with the fluid conveyance system are horizontally aligned when the deckplate structure is mounted on the horizontal surface.

11. The waterfall deckplate assembly of claim 9, wherein the storage compartment is disposed below the nozzle manifold coupled with the fluid conveyance system when the deckplate structure is mounted on the horizontal surface.

12. The waterfall deckplate assembly of claim 11, wherein the nozzle manifold coupled with the fluid conveyance system discharges fluid from a first elongate side of the deckplate structure and the storage compartment is accessible through a removable cover disposed on a second elongate side of the deckplate structure disposed opposite the first elongate side.

13. The waterfall deckplate assembly of claim 9, wherein at least one of the first plurality of discharge nozzles and the second plurality of discharge nozzles are adjustable nozzles.

14. The waterfall deckplate assembly of claim 9, wherein the first nozzle manifold and the second nozzle manifold each include at least one flexible prong for engaging the assembly and thereby securing the nozzle manifold to the assembly and wherein the assembly includes a user-accessible engagement member wherein manual manipulation of the engagement member disengages the at least one flexible prong and thereby allows removal of the nozzle manifold from the assembly.

15. A faucet assembly comprising:

a faucet having a waterway connectable to a water supply, the waterway extending to a discharge outlet, and a user operable first control valve for controlling the flow of water through the waterway to the discharge outlet; and a deckplate assembly comprising:

a deckplate structure adapted to be mounted on a horizontal surface; and a fluid conveyance system coupled with deckplate structure, the fluid conveyance system adapted to be connected to a fluid supply and including:

a plurality of discharge nozzles supported by the deckplate structure wherein the plurality of discharge nozzles are horizontally aligned when the deckplate structure is mounted on the horizontal surface;

a user operable second control valve wherein the second control valve is operable to selectively allow fluid flow to the discharge nozzles and prevent fluid flow to the discharge nozzles independently of the operation of the first control valve; and wherein both the first control valve and the second control valve are mixing valves adapted to be coupled with a hot water supply and a cold water supply.

16. The faucet assembly of claim 15, wherein a diverter valve is disposed between the first control valve and the second control valve, with both the waterway and the fluid conveyance system being disposed downstream of the diverter valve and the first control valve being disposed upstream of the diverter valve.

17. The faucet assembly of claim 15, wherein the second control valve includes a user operable actuator projecting above the deckplate structure for operating the second control valve.

18. The faucet assembly of claim 17, comprising a plurality of user operable actuators interchangeably installable on the second control valve, each of the plurality of user operable actuators having a different exterior appearance.

19. The faucet assembly of claim 15, wherein the plurality of discharge nozzles are disposed on a first nozzle manifold and the assembly includes a second plurality of discharge nozzles disposed on a second nozzle manifold, the first and second nozzle manifolds being interchangeably installable in the fluid conveyance system; and wherein the deckplate structure defines a storage compartment whereby one of the first and second nozzle manifolds not installed in the fluid conveyance system is storable in the storage compartment.

20. The faucet assembly of claim 15, wherein the plurality of discharge nozzles are disposed on a nozzle manifold wherein the nozzle manifold includes at least one flexible prong for engaging the assembly and thereby securing the nozzle manifold to the assembly and wherein the assembly includes a user-accessible engagement member wherein manual manipulation of the engagement member disengages the at least one flexible prong and thereby allows removal of the nozzle manifold from the assembly.

21. The faucet assembly of claim 15, wherein the deckplate structure defines an opening and the faucet is mounted on the deckplate structure at the opening.

22. The faucet assembly of claim 15, wherein the waterfall deckplate assembly is adapted to be mounted proximate the faucet whereby both the waterfall deckplate assembly and the faucet discharge fluid into a common basin with the faucet being mounted separately and spaced apart from the deckplate assembly.

23. A faucet assembly comprising:

a faucet having a waterway connectable to a water supply, the waterway extending to a discharge outlet, and a user operable first control valve for controlling the flow of water through the waterway to the discharge outlet; and a deckplate assembly comprising:

a deckplate structure adapted to be mounted on a horizontal surface;

a first plurality of discharge nozzles disposed on a first nozzle manifold and a second plurality of discharge nozzles disposed on a second nozzle manifold;

a fluid conveyance system coupled with deckplate structure, the fluid conveyance system being couplable with a selected one of the first nozzle manifold and the second nozzle manifold, and wherein the fluid conveyance system is connectable to a fluid supply to thereby convey fluid to the selected one of the first nozzle manifold and the second nozzle manifold coupled with the fluid conveyance system;

a user operable control valve disposed in the fluid conveyance system wherein the control valve is operable to selectively allow fluid flow to the discharge nozzles and prevent fluid flow to the discharge nozzles; and wherein the first nozzle manifold and the second nozzle manifold are interchangeably couplable to the fluid conveyance system and the deckplate structure defines a storage compartment whereby a non-coupled one of the first nozzle manifold and the second nozzle manifold is storable in the storage compartment.

24. The faucet assembly of claim 23, wherein the plurality of discharge nozzles of the nozzle manifold coupled with the fluid conveyance system are horizontally aligned when the deckplate structure is mounted on the horizontal surface.

25. The faucet assembly of claim 23, wherein the storage compartment is disposed below the nozzle manifold coupled with the fluid conveyance system when the deckplate structure is mounted on the horizontal surface.

26. The faucet assembly of claim 25, wherein the nozzle manifold coupled with the fluid conveyance system discharges fluid from a first elongate side of the deckplate structure and the storage compartment is accessible through a removable cover disposed on a second elongate side of the deckplate structure disposed opposite the first elongate side.

27. The faucet assembly of claim 23, wherein the first nozzle manifold and the second nozzle manifold each include at least one flexible prong for engaging the assembly and thereby securing the nozzle manifold to the assembly and wherein the assembly includes a user-accessible engagement member wherein manual manipulation of the engagement member disengages the at least one flexible prong and thereby allows removal of the nozzle manifold from the assembly.

* * * * *